US010246939B1

(12) United States Patent
Neubauer et al.

(10) Patent No.: US 10,246,939 B1
(45) Date of Patent: Apr. 2, 2019

(54) FOLDING AND RIGID LADDER WITH EXTENSIONS

(71) Applicant: Blue Moon Designs, LLC, Bend, OR (US)

(72) Inventors: Dale Martin Neubauer, Bend, OR (US); Scott Charles Silver, Bend, OR (US)

(73) Assignee: Blue Moon Designs, LLC, Bend, OR (US)

( * ) Notice: Subject to any disclaimer, the term of this patent is extended or adjusted under 35 U.S.C. 154(b) by 71 days.

(21) Appl. No.: 15/435,342

(22) Filed: Feb. 17, 2017

Related U.S. Application Data

(60) Provisional application No. 62/297,247, filed on Feb. 19, 2016.

(51) Int. Cl.

| | |
|---|---|
| ***E06C 7/50*** | (2006.01) |
| ***E06C 1/20*** | (2006.01) |
| ***E06C 1/38*** | (2006.01) |
| ***E06C 7/18*** | (2006.01) |

(52) U.S. Cl.
CPC ..... *E06C 1/20* (2013.01); *E06C 1/38* (2013.01); *E06C 7/183* (2013.01); *E06C 7/50* (2013.01)

(58) Field of Classification Search
CPC ..... E06C 7/50
See application file for complete search history.

(56) References Cited

U.S. PATENT DOCUMENTS

| | | | | | |
|---|---|---|---|---|---|
| 311,272 | A | | 1/1885 | Tibbals | |
| 353,868 | A | * | 12/1886 | Koerner | |
| 550,175 | A | * | 11/1895 | Holden | |
| 572,201 | A | * | 12/1896 | Hausmann | |
| 986,953 | A | | 3/1911 | Soule | |
| 1,520,414 | A | * | 12/1924 | Hamilton | E06C 1/10 182/151 |
| 2,024,039 | A | * | 12/1935 | Harting | E06C 1/32 16/326 |
| 2,172,860 | A | | 9/1939 | Weaver | |
| 2,887,260 | A | * | 5/1959 | McKinnie | E06C 1/22 182/168 |
| 3,703,939 | A | * | 11/1972 | Maxwell | A01M 31/00 182/107 |
| 3,768,592 | A | * | 10/1973 | Higgins | E06C 1/16 182/129 |
| 3,954,155 | A | | 5/1976 | Guidara | |
| 4,483,415 | A | * | 11/1984 | Disston | E06C 1/22 182/129 |
| 4,494,626 | A | | 1/1985 | Ast | |
| 4,569,419 | A | | 2/1986 | Stoltz | |
| 5,551,529 | A | | 9/1996 | Molitor | |

(Continued)

FOREIGN PATENT DOCUMENTS

FR 2970027 A1 7/2012

*Primary Examiner* — Alvin C Chin-Shue

(74) *Attorney, Agent, or Firm* — Hancock Hughey LLP

(57) ABSTRACT

An extension module is provided for attachment to a folding or rigid ladder to extend the effective working height of the ladder. A ladder that is designed for use with an extension module according to the invention defines the base module to which the extension module is attached. Cooperatively constructed interconnecting structures on the ladder and the extension module operate to secure the extension module to the ladder and to stabilize the combination of the ladder with the extension.

13 Claims, 24 Drawing Sheets

(56) References Cited

U.S. PATENT DOCUMENTS

| | | | | |
|---|---|---|---|---|
| 6,141,829 | A | 11/2000 | Boyer | |
| 8,485,316 | B2 * | 7/2013 | Vestal | E06C 1/10 182/107 |
| 8,602,162 | B2 | 12/2013 | Dondurur et al. | |
| 8,701,831 | B2 | 4/2014 | Moss et al. | |
| D722,181 | S | 2/2015 | Green | |
| 9,038,775 | B2 | 5/2015 | Durkin | |
| 9,038,776 | B2 | 5/2015 | Green | |
| 2016/0024844 | A1 | 1/2016 | Neubauer | |

* cited by examiner

FOLDING AND RIGID LADDER WITH EXTENSIONS

FIELD OF THE INVENTION

The present inventions are generally directed to light-weight moveable safety ladders and work platforms and more specifically to ladders and platforms that can be placed in close proximity to helicopters, aircraft and other vehicles or equipment in order to provide human workers with a safe and stable means of accessing, inspecting or servicing those and similar machines. More specifically, the inventions are defined by ladder adapted for an extension unit that may be combined with an existing folding ladder to extend the length of the ladder.

BACKGROUND INFORMATION

Aircraft, and most especially helicopters, require regular inspection and maintenance by trained mechanics. In order to gain close access to surfaces, parts or areas higher than can be reached while standing upon the ground, it is necessary to use a ladder or work platform of adequate height.

When work must be performed in the field, on the flight-line or elsewhere where no dedicated stationary platform is available, the mechanic will use a portable platform or ladder. Most frequently a conventional hinged aluminum folding-ladder is used. Such ladders are light in weight, can be carried by a single person and placed adjacent to the helicopter as required. Such ladders, however, are not stable. They can be hazardous when used correctly and dangerous when used incorrectly or when a mechanic is struggling to lift a heavy part or tool.

Furthermore, a conventional folding ladder cannot be positioned relative to the curved body of a helicopter in a manner so that the mechanic is positioned in close proximity to the aircraft. Whether placed parallel to or at an angle to the body of a helicopter, the poor fit of the ladder to the aircraft compromises the ability of the mechanic to perform his work and creates a hazardous condition when he is forced into awkward or unstable positions.

Lightweight, portable ladders or platforms that are truly safe, stable and which may be positioned so as to provide the kind of uncompromised access a mechanic requires are not known in the art. One product that is on the market is called the Aircraft MRO Pylon Ladder manufactured by Lock-N-Climb LLC (http://lockclimb.com/pylon-ladder/). This is a light-weight cantilevered aluminum stepladder that may be used for aircraft maintenance, but which fails to provide a truly safe and stable platform. This ladder is a conventional stepladder to which shortened support rails have been attached at about the mid-point of the stepped rails. To partially compensate for the shortness of the support rails, angled extensions have been affixed to the top end of those rails. It is apparent that the support legs will not fold flat against the stepped legs, thus making the ladder excessively bulky when in its folded position. The support legs are, of necessity, braced and cross-braced such that they cannot straddle the cross-tubes of a helicopter's skid assembly and would be unusable in many applications. Furthermore, because the support legs of the Pylon Ladder do not extend beyond the bottom of the stepped legs when the ladder is in the folded position and do not make a more acute angle to the ground than do the stepped legs when the ladder is in its open, operational, position, the Pylon Ladder would be expected to provide less than optimal resistance to forward tipping.

Folding step ladders are required by regulatory standards to have a locking mechanism on each side of the ladder that will prevent the spreader arms from articulating when the ladder is in use. More specifically, the purpose of this locking mechanism is to ensure that the ladder does not fold up when a worker is standing on the ladder rungs. The most conventional form of a locking mechanism is defined by the well-known braces that extend between the stepped side of the ladder and the support side of the ladder. The braces typically have a first elongate arm that is pivotally attached to a rail of the stepped unit, a second elongate arm that is pivotally attached to the support unit, and one-way locking hinge mechanism interconnecting the two elongate arms. In use, as the support unit is articulated away from the stepped unit to move the ladder to its open position, the braces are locked by pushing down on the one-way hinge mechanism. Doing so causes the spreader arms to align end-to-end or causes them to move into a slightly over-centered configuration. While no actual locking occurs at the brace mechanism, there is a frictional jamming that occurs and which is sufficient to ensure that the ladder will not collapse when stood upon.

The conventional spreader arm locks just described generally meet regulatory safety requirements and prevent an open ladder from closing when stood upon. These locks, however, do not engage automatically, and they require that the user push down the lock to fully engage the locking hinge mechanism when the ladder is opened. Failure to perform this action negates this safety feature and the ladder can accidentally collapse when in use. Moreover, the spreader arms may be inadvertently moved away from the locked position when the ladder is jostled and jarred as it is moved from one position to another. This has the potential of causing a dangerous condition where the spreader arms collapse when a user climbs the steps.

Additionally, most folding ladders have a fixed length. There are many known types of extension ladders, and there are known examples of folding or step ladders that have the ability to be extended. For example, some manufacturers have combined the structures of conventional extension ladders with folding step ladder design. But since many ladder users require ladders of varying lengths (as evidenced by the popularity of conventional extension ladders), there is a need for folding ladders that are able to be of multiple lengths and which are safe for the users.

SUMMARY OF THE INVENTION

It is an object of the invention to devise a portable ladder that can be manipulated by one person and be placed in close proximity to a helicopter, an aircraft or to another piece of equipment.

It is an object of the invention to devise a portable ladder than can closely nest with the curved body of a helicopter, aircraft or equipment and by so doing, provide ready access to a variety of surfaces and areas.

It is an object of the invention to have the ability to clear, straddle or otherwise avoid interference with portions of the aircraft or other equipment to which the ladder is being placed adjacent.

It is an object of the invention to provide enhanced access to the upper portions of otherwise difficult to access parts, such as to the rotor assembly of a helicopter.

It is an object of the invention to provide enhanced stability in comparison to conventional step ladders.

It is an object of the invention to provide stepped rungs upon which a person can stand that are cantilevered with respect to the attachment point of the supporting legs.

The ladder described in this invention has two pairs of legs (commonly known as "rails"). Typically, one pair of rails is longer than the other. The longer pair is interconnected with rungs or steps and designed to be stood upon. The shorter pair of rails is interconnected with bracing and designed to provide stability. The longer pair of rails when connected with steps or rungs is hereafter referred to as the 'stepped unit'. The shorter pair of rails when connected with bracing is hereafter referred to as the 'support unit'.

The two units are attached to each other at a hinge-point located some distance below the top of the stepped unit. The two units are further attached to each other by a brace which can retract when the ladder is in the folded position and can extend to hold the ladder in the open position.

When in the folded position, the two units are ostensibly parallel and in close proximity to one another. In the folded position, the lower portion of the support unit extends beyond the lowest portion of the stepped unit.

When unfolded and locked in place by the side braces, the two units are held at different angles with respect to the ground. The angle of the stepped unit is typical of a conventional folding ladder. The angle of the support unit is more acute.

The hinge point is typically located within about the middle third of the stepped unit. The upper portion of the stepped unit is thus cantilevered with respect to the hinge point. The ladder is constructed of materials sufficient to permit a person to stand one or more rungs above the hinge point.

When the ladder is placed at approximately right angles to the aircraft, the curved body of the aircraft fits within the space defined by the stepped and support units. By selecting appropriate rail lengths and an appropriate attachment point location, ladders can be tailored to fit specific aircraft profiles.

Another object of the present invention is to provide a mechanism that physically locks the spreader arms so that they are prevented from articulating inadvertently when the ladder is being stood upon.

Objects of the invention include locking the spreader arms so they are prevented from articulating when the ladder is tilted back toward the operator and the support rails are lifted into the air and to physically lock the stepped rails and the support rails at a fixed distance apart, a distance that will not increase when the operator stands upon the ladder.

Yet another object of one aspect of the invention is to provide a fully automatic mechanism for locking the spreader bars relative to one another.

In another aspect of the invention, an object is to provide an extension module that may be securely coupled to the ladder of the invention to effectively increase the working height of the ladder.

BRIEF DESCRIPTION OF THE DRAWINGS

The foregoing and other features of the invention will be apparent from the following, more particular descriptions of exemplary embodiments of the invention, as illustrated in the accompanying drawings. Like reference numbers indicate identical or functionally and/or structurally similar elements.

in FIG. 7 the ladder is shown in an intermediate position between the open, working position and the folded, storage position.

FIG. 13 is an upper perspective view of one embodiment of a ladder according to the invention, showing the ladder in the working position, wherein the ladder shown has an extension module of a first length secured in place.

FIG. 14 is an upper perspective view of another embodiment of a ladder according to the invention, showing the ladder in the working position, wherein the ladder shown has an extension module of a second length secured in place.

FIG. 15 is an upper perspective view of another embodiment of a ladder according to the invention, showing the ladder in the working position, wherein the ladder shown has an extension module of a third length secured in place.

DETAILED DESCRIPTION OF EMBODIMENTS OF THE INVENTION

Figure 1:
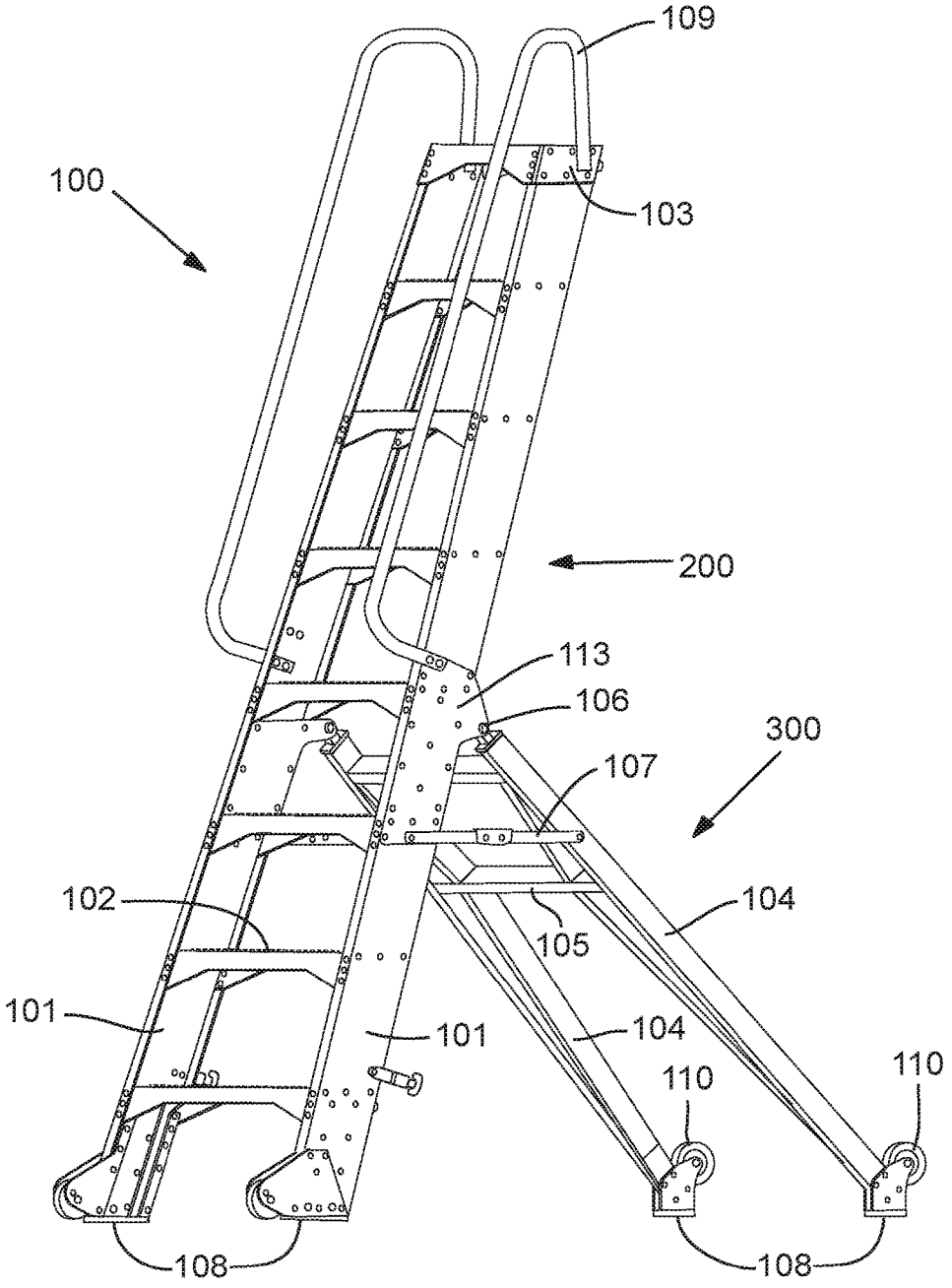
FIG. 1 is a perspective view of a first embodiment of the present invention in which the support unit is hinged to the stepped unit within about the middle third of the length of the stepped unit.

Exemplary embodiments are discussed in detail below. While specific exemplary embodiments are discussed, it should be understood that this is done for illustration purposes only. Persons skilled in the relevant art may recognize that other components and configurations may be substituted without parting from the spirit and scope of the invention. It is to be understood that each specific element includes all equivalents that operate in a similar manner to accomplish a similar purpose Referring now to FIG. 1, a lightweight, portable, safety ladder and work platform 100 according to the first embodiment of the present invention is shown. The ladder is comprised of two pairs of rails. To one pair of rails 101 steps 102 and a top plate 103 are attached. This combination of rails, steps and top plate will be referred to as the 'stepped unit' 200. The other pair of rails 104 are braced 105 to each other as can most clearly be seen in FIG. 3. The combination of braced rails will be referred to as the 'support unit' 300. The support unit is attached to the stepped unit with hinges 106 and foldable braces 107. The length of the support rails and the location of the hinge attachment point or points along the stepped unit are variables which can be optimized for use with specific aircraft and helicopters. The bottom ends of the stepped rails 101 and the support rails 104 are fitted with pads 108 that assist in preventing the ladder from slipping. Attached to the stepped unit is a pair of handrails 109. In this embodiment, the stepped rails are further apart where they touch the ground than where they are joined at the top plate. Similarly, the support rails are further apart where they touch the ground than where they are joined to the stepped unit at the two hinge points.

Figure 2:
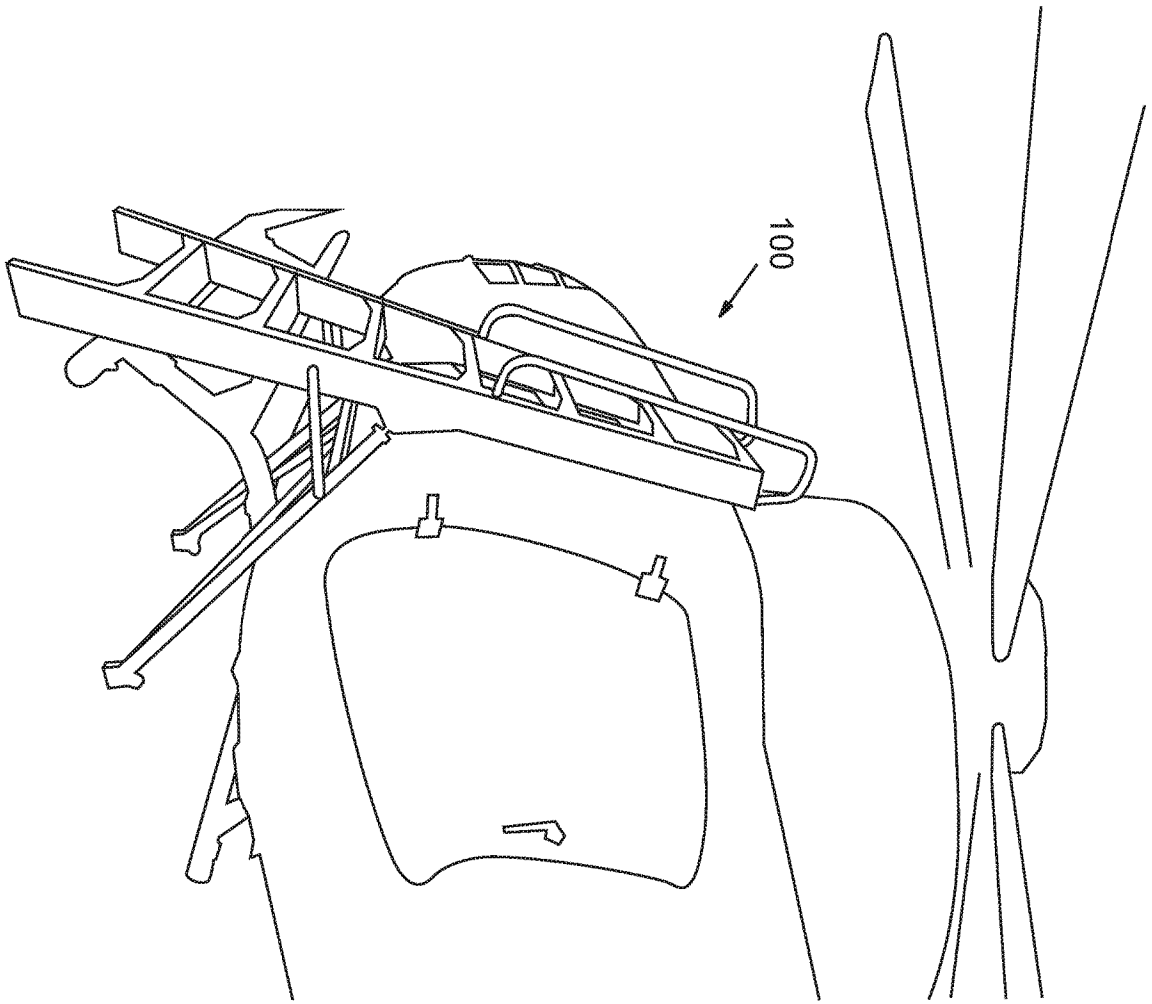
FIG. 2 illustrates an embodiment of the portable ladder according to an embodiment of the invention with the ladder nested in close proximity to a helicopter.

FIG. 2 illustrates an embodiment of the present invention in close proximity to an aircraft ready to be used for its intended purpose.

Figure 3:
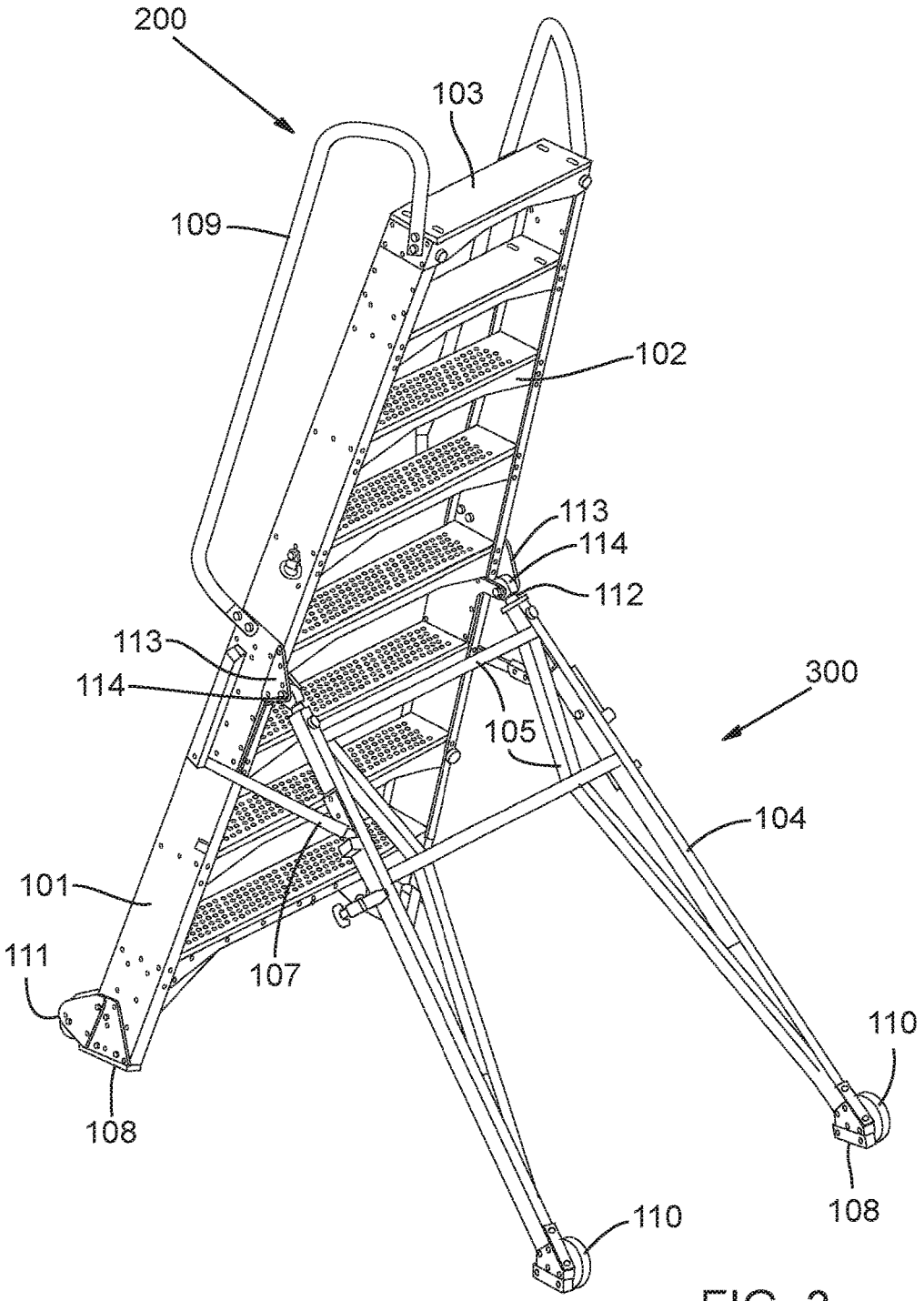
FIG. 3 is an isometric view of an embodiment of the support unit according to the invention braced such that it can straddle objects between the support rails.

FIG. 3 depicts an isometric view of an embodiment of the safety ladder such that the support unit 300 is clearly visible. The support rails 104 are shown with internal bracing 105 that rigidly holds the two members and provides the structural strength necessary to meet the load requirements of the ladder. The bracing is constructed so as to leave the space between the rails empty, thus permitting the unit to fit over obstacles such as the helicopter skid cross tubes seen in FIG. 2.

The ladder depicted in FIG. 3 is fitted with wheels 110 on upward facing edges of the support rails 104 and wheels 111 the backward facing edges of the stepped rails. Such wheels can be of assistance in transporting the ladder to the work area and in positioning the ladder in proximity to the aircraft.

The stepped unit 200 and support unit 300 are interconnected through the use of two rod end ball joints 112. These rod end ball joints are better seen in the enlarged view provided in FIG. 3*a*.

Figure 3A:
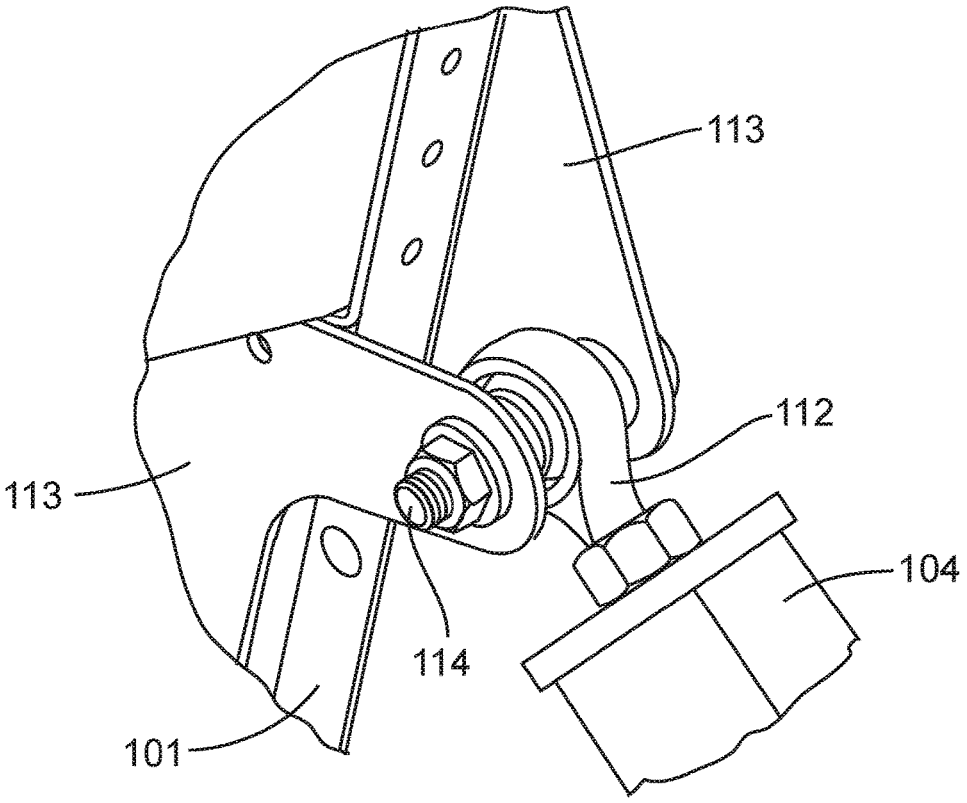
FIG. 3*a* is an enlarged perspective view of the rod end ball joint used as a hinge mechanism in the embodiment shown within FIG. 3.

In FIG. 3*a* the rod end ball joint 112 is securely attached to the top end of the support rail 104. Two brackets or plates 113 are securely attached to the stepped rail 101 in the area where the support unit and stepped unit will be joined. A securing bolt 114 passes through corresponding holes in those plates and through the eye of the rod end ball joint, thus completing the hinge assembly.

Figure 4:
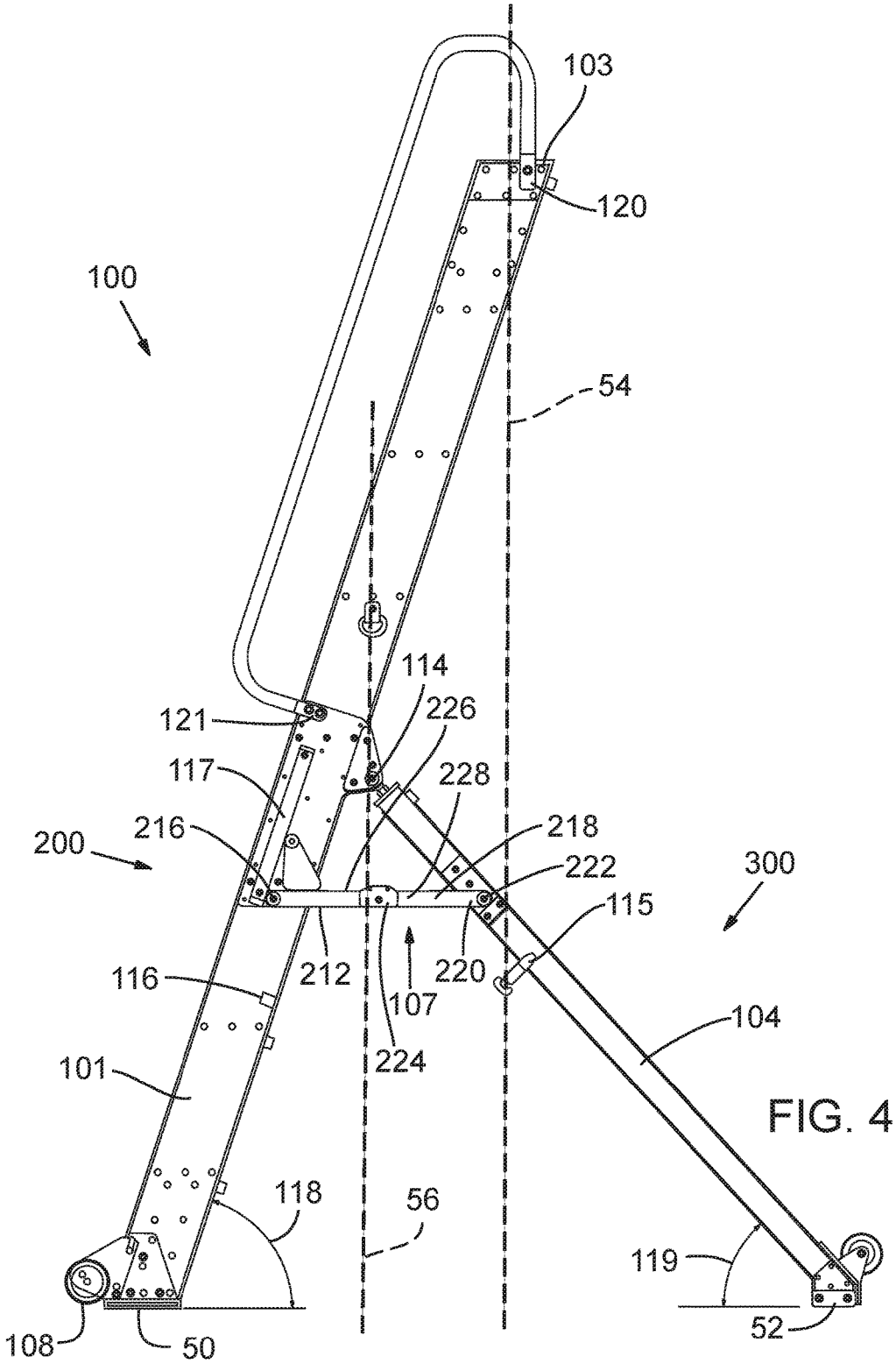
FIG. 4 is a side elevation view of an embodiment of a portable ladder according to the invention in an open position where the angle measured between the ground and the stepped unit is greater than the angle between the ground and the support unit.

FIG. 4 depicts a side view of an embodiment of the ladder in its open position. A latching strap 115 is secured to the stepped rail 104 and a corresponding latching hook 116 is secured to the support rail 101. When the ladder is in the closed position, the latching strap and latching hook may be joined to secure the stepped unit 200 to the support unit 300. A protective bumper 117 is affixed to the stepped rail. When the ladder is in the closed position and laid on the ground upon its side, the bumper acts to protect the folding side braces 107.

In FIG. 4, it can be seen that the angle measured between the ground and the stepped rail 118 is greater than the angle measured between the ground and the support rail 119. Moreover, in FIG. 4 it may be seen that when the ladder 100 is in the open, working position, the top plate 103 is located beyond the hinge axis that is defined by securing bolt 114 (see FIG. 3*a*; the securing bolt is also referred to as the "hinge axis 114"). In the side elevation view of FIG. 4 the foot of the stepped unit 200 is identified with reference number 50 and the foot of the support unit 300 is identified with reference number 52. If a triangle is defined by the lines interconnecting the hinge axis 114, foot 50 and foot 52, then the horizontal location of top plate 103 is to the right of hinge axis 114 and to the left of foot 52. Stated another way, when the ladder 100 is in the open position and located on a horizontal ground plane, then a vertical line drawn from the top plate 103 to the ground plane intersects the line extending from the foot 50 to the foot 52 at a position intermediate between the intersection of a line extending from hinge axis 114 to the line extending from the foot 50 to the foot 52. These two vertical lines are illustrated in phantom lines in FIG. 4, labelled with reference numbers 54 and 56, respectively. This geometric orientation is distinctive and important.

Figure 5:
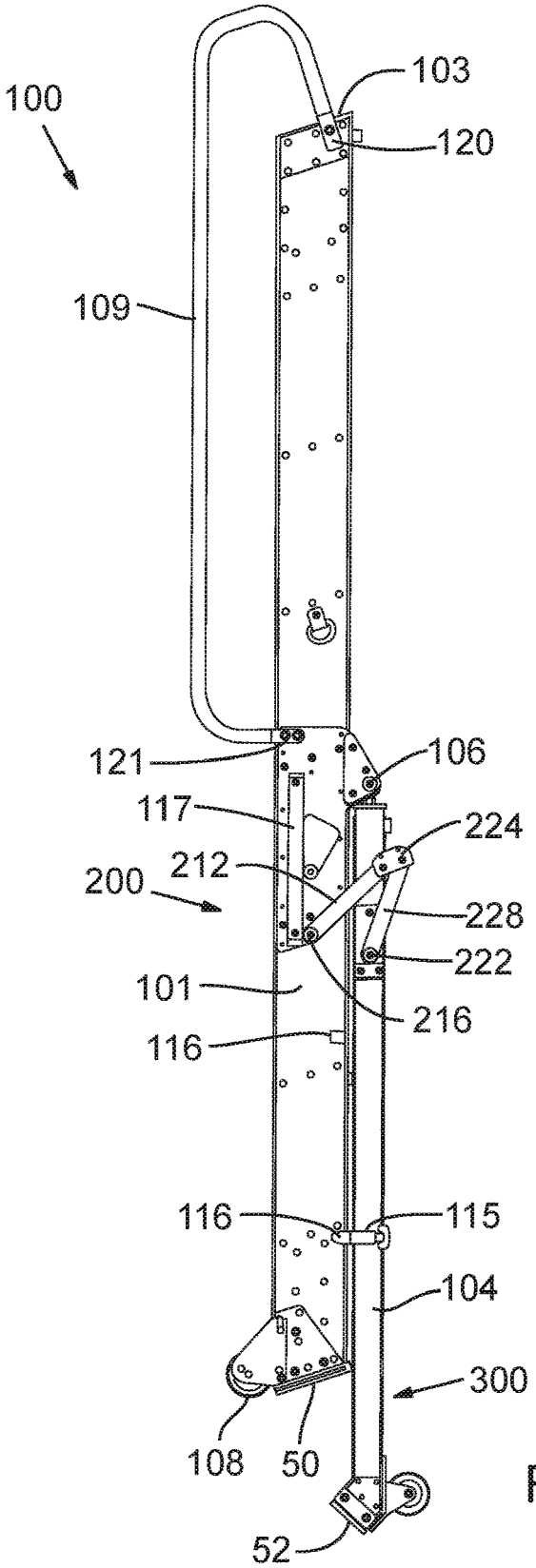
FIG. 5 is a side elevation view of an embodiment of a portable ladder in a folded position in which the support unit extends beyond the bottom of the rails of the stepped unit.

FIG. 5 depicts a side view of an embodiment of the ladder in its closed position. In this depiction, the latching strap 115 is secured to its corresponding latching hook 116 thus holding the stepped and support units together for ease of transport. In this closed and latched position, the support rails 101 are in a close and substantially parallel orientation with respect to the support rails 104, thus minimizing the space requirement for storing or transporting the ladder. The handrails 109 are secured to the stepped unit with removable bolts at attachment points 120 and 121. The handrails may be detached from the ladder by removal of the bolts, further minimizing the space requirement for storing or transporting the ladder.

In FIG. 5, it can be seen that the support legs 104 extend beyond the bottom of the stepped rails 101 and below the friction pads 108 secured to the end of those rails.

Materials, Design Considerations and Operation

Based upon the foregoing description of the elements, their configuration and interconnection, one skilled in the art would be expected to be able to construct a lightweight portable ladder that provided the advantages possessed by described embodiments of the present invention. Described here are additional details related to the material used, design considerations and operation of the ladder.

Because safety and stability are characteristics of paramount importance, design consideration can augment the suitability of the ladder for its intended purpose. In FIGS. 1, 2, 3 and 6 embodiments of the ladder are depicted with both the support rails 104 and the stepped rails 101 being spaced wider apart at their bottom end than at their top end.

With respect to the stepped rails 101 of the stepped unit 200, the wider stance at the friction pads 108 provides additional stability. The shortening of the steps 102 which occurs as one traverses up the ladder serves to centralize the mass and to provide additional stability through those means. The narrowed stance at the upper steps further serves to bring the handrails 109 into a more convenient position to be gripped by the person standing upon the ladder.

With respect to the support rails 104 of the support unit 300, the wider stance at the friction pads 108 provides additional stability which is further enhanced owing to the fact that the support rails 104 are longer than the stepped rails as measured from the hinge point 106. Because the angle of flare is ostensibly the same for the rails of both the support unit and the stepped unit, the added length of the support rails results in the friction pads 108 of the support unit being spread still further apart. These more widely spaced foot pads act as if they were outriggers and provide enhanced stability in the lateral direction.

With further respect to the support rails 104 of the support unit, it should be apparent to those skilled in the art that their extended length provides increased resistance to tipping forward, thus allowing the ladder to support heavier loads being applied higher above the hinge point 106. In order to accommodate these higher loads and forces, the support rails 104 and support rail bracing 105 must be constructed using appropriately strong materials. High tensile strength aluminum tubing has proven to be suitable for this purpose. Various other metals, alloys, fiberglass and composites might also prove suitable.

With further respect to the issue of safety and stability, in the embodiment depicted in FIGS. 1, 2 and 3 the rails 101 and steps 102 are oversized compared to those found in conventional stepladders. These larger steps better facilitate the safety ladder and work platform functions of the present invention giving the mechanic a stronger and larger platform upon which to stand. The presence of handrails 109 further add to the safety features of this ladder.

Persons skilled in the art understand that step ladders can be constructed using a variety of hinge mechanisms 106. Any number of hinged mechanisms that would permit the stepped unit to smoothly swing relative to the support unit could be used to construct a ladder that shared many of the advantages of the present invention. For example, a continuous hinge (commonly called a 'piano' hinge) could be used such that one flap is affixed to the backside of a step 102 and the other flap is affixed to bracing 105 connecting the top ends of the support rails 104. An obvious limitation of using this arrangement would be that that there are a discrete number of steps thus a limited number of structurally appropriate attachment points.

Because it is desirable to construct a helicopter maintenance ladder with optimized angles, it is important to be able to locate the hinge points wherever the design requires. It is further desirable for those hinges to operate smoothly without binding and with a minimum of free play which, if present, would permit the ladder to wiggle or shake. The limitation described for the embodiment using a continuous hinge can be overcome by using a pair of rod end ball joints 112 or functional equivalents such as spherical rod end ball joints, race linkage rod ends or rod end bearings. Such joints may be affixed to the top ends of the support rails 104 and corresponding attachment means affixed to the rails 101 of the stepped unit wherever the design requires. Alternately, attachment means may be affixed to the top end of the support rails 104 and corresponding rod end ball joints affixed to the rails 101 of the stepped unit. Such flexibility facilitates the construction of a ladder having angles optimized for its intended use. Another advantage of using paired rod end ball joints in this application is that paired joints permit ostensibly zero motion in any direction other than the desired axis of rotation. When used as the hinge element in the construction of embodiments of the present invention, rod end ball joints contribute greatly to the production of safety ladders that are exceptionally stable and secure.

With respect to moving the ladder from where it may be stored to where it will be employed, the ladder may be found to be light enough to be carried by one person. Alternatively, the ladder, preferably in its closed position as seen in FIG. 5, can be rolled to the work site using attached wheels 110 or 111. The safety hand rails 109 provide a convenient handle when pushing or pulling the ladder upon either pair of wheels.

In operation, the ladder is brought into its full open position by pivoting the rails 101 and 104 upon the hinge mechanism 106 until the folding braces 107 are fully extended. Once extended, the folding braces lock the ladder into its operational position. Once so locked the ladder is moved into its ultimate work position either by manually lifting, or tilting and then rolling it upon wheels 111, or by dragging, or by rocking it upon the friction foot pads 108 and/or by combinations thereof. As most clearly seen in FIG. 2, in order to place the ladder in its optimal work position, it may be necessary to clear, straddle or otherwise avoid contact with various portions of the aircraft or helicopter. A properly constructed embodiment of the present invention will have taken into consideration the nature and location of those obstacles and will integrate well with the aircraft for which it was designed.

To further enhance the utility of the present invention as a work platform for the maintenance of aircraft, helicopters and other machinery, the ladder may be fitted with additional accessories such as trays, tool and part holders, cup holders and the like. These accessories may be permanently attached, hung from the ladder, or attached by temporary or removable means. In an embodiment of the current invention not shown in any of the figures, the ladder is fitted with receptacles sized to receive a quart-sized can of motor oil mounted on the outboard surfaces of each of the two stepped rails 101 near the top plate 103. These receptacles provide convenient repositories for the placement of small parts when the ladder is in use and further serve as protective bumpers when the ladder is laid upon either side.

Figure 6:
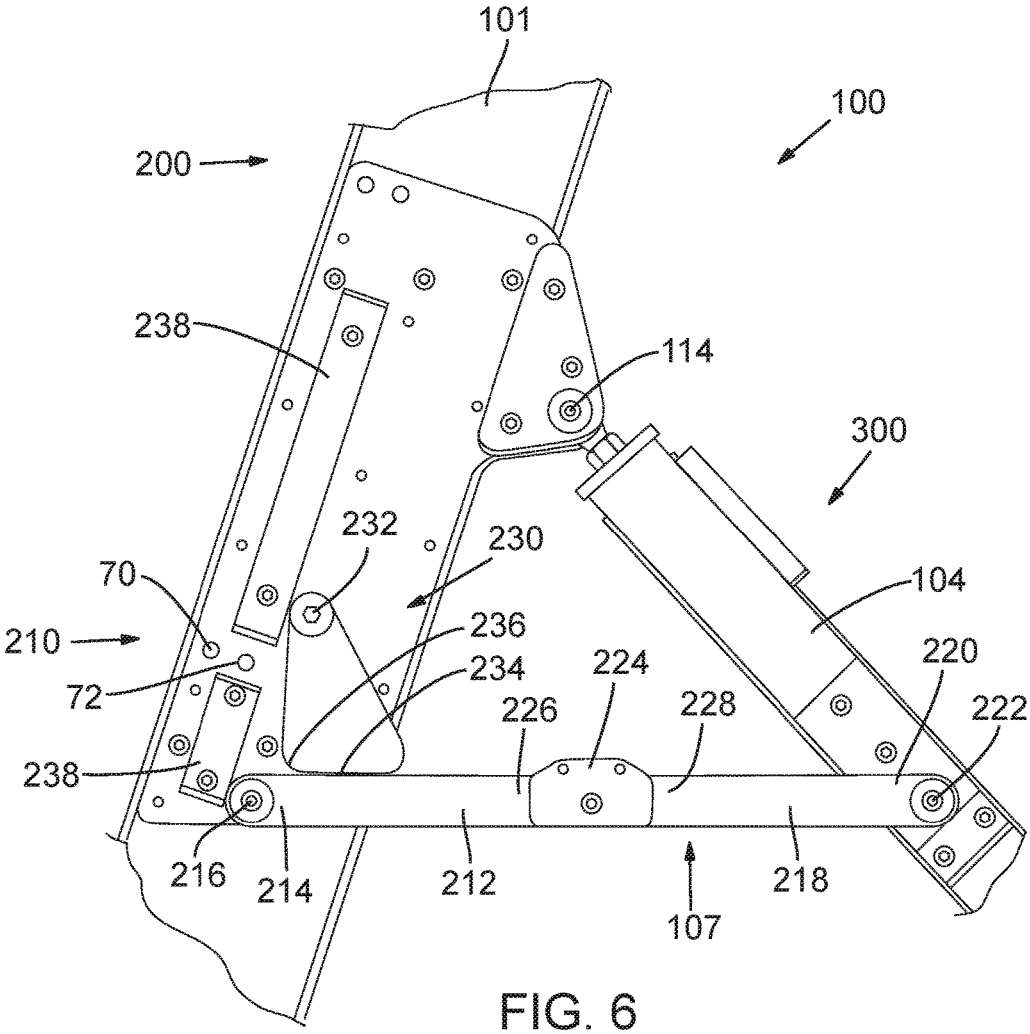
FIG. 6 is a close up side elevation view of a brace locking mechanism according to the present invention, illustrating the mechanism in the locked position when the ladder is in the open, working position.
Figure 7:
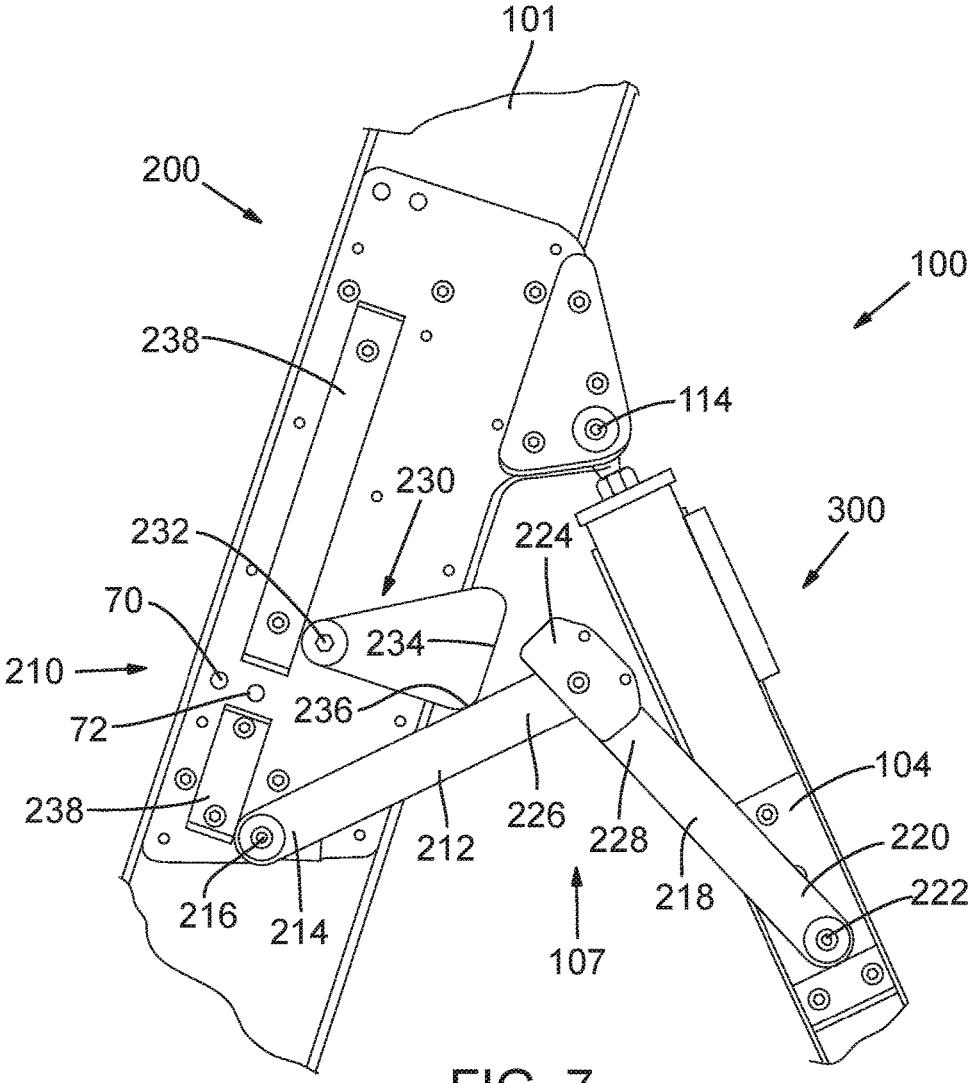
FIG. 7 is a side elevation view of the brace locking mechanism shown in FIG. 6, illustrating the mechanism being moved out of its locking position to an open position so that the ladder may be folded into its storage position.
Figure 8:
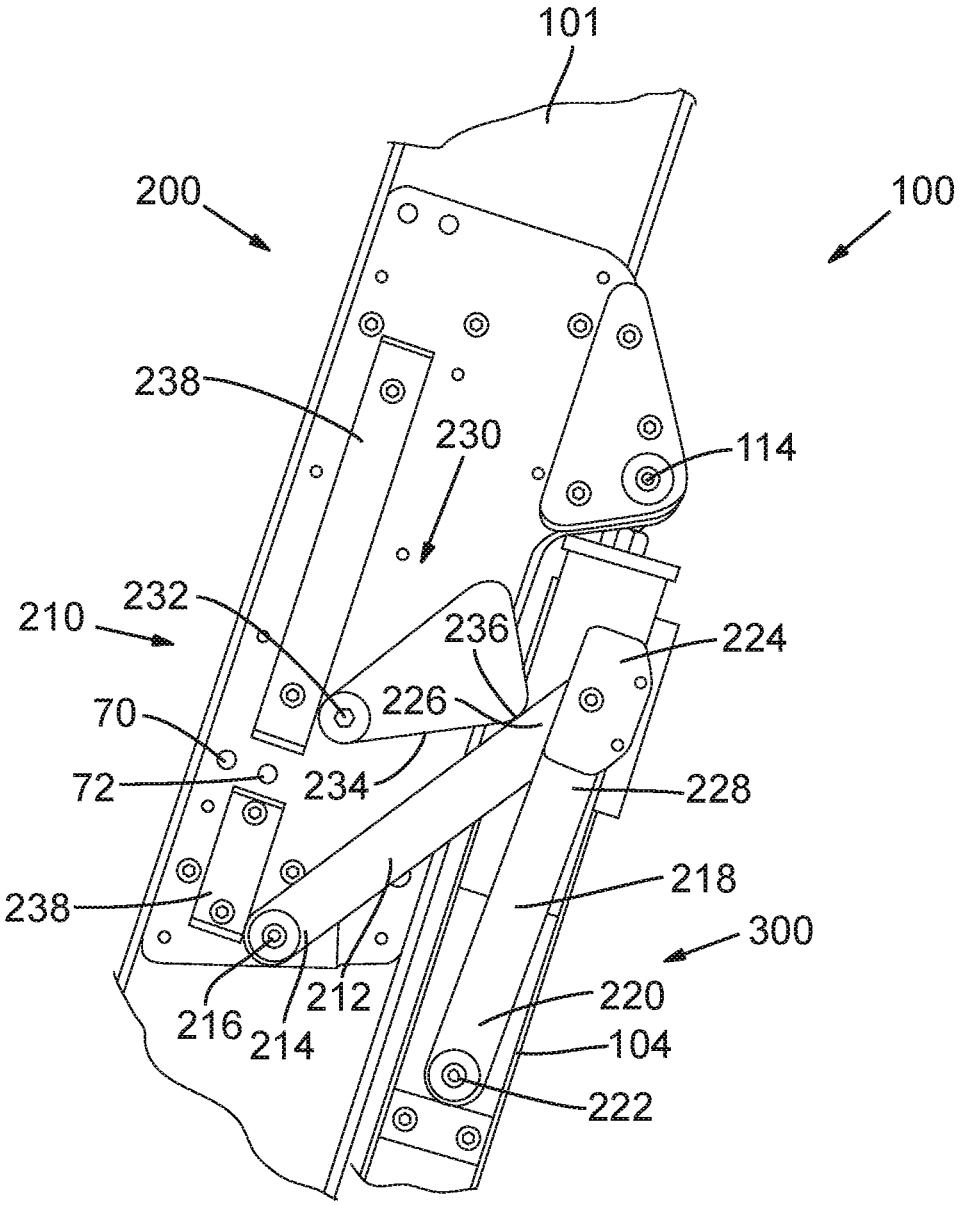
FIG. 8 is a side elevation view of the brace locking mechanism shown in FIGS. 6 and 7, and is a sequential step showing the mechanism as the ladder is moved fully into the storage position.

Reference is now made to FIGS. 6 through 8, which illustrate a brace locking mechanism 210 according to the present invention. The purpose of brace locking mechanism 210 is to lock the foldable braces 107 when the ladder 100 is in the open position. With returning reference to the basic structural components of ladder 100 described previously, and for example, as shown in FIG. 1, the brace locking mechanism of FIGS. 6 through 8 is used with a ladder 100 that has a stepped unit 200 and a support unit 300. The foldable brace 107 extends between the stepped unit and the support unit. More specifically, foldable brace 107 is a spreader bar system that is defined by a first elongate arm 212 that has its first end 214 pivotally attached to rail 101 of stepped unit 200, for example, with a bolt 216. Foldable brace 107 further is defined by a second elongate arm 218 that has its first end 220 pivotally attached to rail 104 of support unit 300 with a bolt 222. A conventional one way hinge 224 interconnects the respective, facing ends 226 and 228 of elongate arms 212 and 218. The foldable brace 107 just described is conventional and of course there is a foldable brace 107 interconnecting the rails on both sides of the ladder 100. As with known foldable braces, the one way hinge 224 is operable to limit and stop relative pivotal movements of elongate arms 212 and 218 when the support unit 300 is fully moved into the open position.

Brace locking mechanism 210 comprises a lock block 230 that is pivotally attached to rail 200 with a bolt 232. In FIGS. 6 through 8 the lock block 230 is illustrated as generally triangular in shape with the bolt 232 extending through an upper apex of the triangle, but it will be appreciated that other geometric shapes will have equivalent functionality. It will be appreciated that the major mass of lock block 230 is below the bolt 232 and the lock block will naturally swing under the force of gravity about the bolt 232 toward the position shown in FIG. 6. This is the "locked position" where the ladder 100 is in its fully open, working position. In this position the foldable brace 107 is fully extended and the base leg 234 of triangular lock block 230 is in an abutting relationship with the elongate arm 212 of foldable brace 107. When the lock block 230 is in the position shown in FIG. 6, the base leg 234 physically abuts the elongate arm 212 to thereby prevent the arm from pivoting about bolt 216. Said another way, when lock block 230 is in the locked position of FIG. 6 the foldable brace 107 cannot be moved out of the fully extended and locked position.

To move the ladder 100 out of the open position the lock block 230 is pivoted in the counterclockwise direction (in the view of FIG. 6, and as shown in the view of FIG. 7) about bolt 232. Movement of lock block 230 in the counterclockwise direction disengages the abutting relationship between base 234 of the lock block 230 and elongate arm 212; once the block 230 has been rotated sufficiently that the base 234 has been moved away from arm 212, the foldable brace 107 may be pivoted in a conventional manner about its respective ends, which of course allows the support unit 300 to be pivoted toward the stepped unit 200, out of the work position and into a storage position.

FIG. 7 is the next sequential step in the movement of the ladder 100 from the fully open position to the storage position. As may be seen, as the support unit 300 is moved partially toward the stepped unit 200 so that the ladder 100 is in an intermediate folded position between the fully open and fully closed positions. Elongate arm 212 pivots about bolt 216 and the elongate arm makes contact with the lock block 230 and pushes on the lock block as the ladder is moved toward the closed position, thereby causing the lock block to continue rotation about bolt 232 as the ladder is moved toward the storage position. The rounded corner 236 of lock block 230 eases the rotation of the lock block by the pushing contact of the elongate arm. An elongate blocking member 238 is bolted to rail 101 and is position such that the blocking member 238 prevents over rotation of lock block 230 when the ladder is fully closed—the blocking member 238 may be provided in multiple pieces as shown in FIG. 7, or in a single piece, which is not illustrated. The purpose of the split, multi-piece blocking member 238 shown in FIG. 6 is to allow attachment of a handrail to bores 70 and 72 in the rails, as detailed below.

FIG. 8 further illustrates the brace locking mechanism 210 described above. Sequentially, in FIG. 8 ladder 100 is in the full storage position and it may be seen that brace locking mechanism 210 does not interfere with the stepped and storage units in this position.

It will be appreciated that when ladder 100 is moved to its open position (FIG. 6) from the storage position (FIG. 8), the brace locking mechanism 210 automatically moves into the locked position when the ladder is fully open because the lock block 230 is, relative to the pivot point defined by bolt 232, bottom weighted. Specifically, when the support unit 300 is pivoted about hinge axis 114 and fully away from the stepped unit 200 in the working position, and such that foldable brace 107 is in its engage position (FIG. 6), the lock block 230 rotates under the force of gravity (in the clockwise direction in FIGS. 6-8) and into the locked position. Thus, no operator intervention is required to lock the ladder securely in the work position. In the locked position, the ladder 100 may be moved from one position to another, or rolled on wheels from one location to another where the ladder incorporates wheels without disengaging the brace locking mechanism. To fold the ladder into its storage position, the user must affirmatively rotate the lock block 230 away from its locked position and also disengage the one way hinge 224 of foldable brace 107.

The brace locking mechanism 210 described above may be used with any foldable ladder and is not limited to the cantilevered ladder 100 described herein. In a preferred embodiment a brace locking mechanism is provided on each rail 101. In another preferred embodiment, only one brace locking mechanism is provided on one of the two rails 101. Further, it will be appreciated that the lock block described above may be attached to the rails 104 of the support unit 300 to define a functionally equivalent brace locking mechanism.

Although not shown in the drawing, the brace locking mechanism 210 may also incorporate a spring that functions to normally drive the lock block 230 into the locking position. The lock block could be move out of the locking position by rotating it in the counter clockwise direction (of the drawings) against the force of the spring. Further, the locking mechanism 210 may include a safety-type mechanism that secures the lock block 230 in the locked position, such as a ball detent or a locking pin and the like. Those of skill in the art will also recognize that there are numerous structural equivalents to lock block 230 that perform the same function. As a few examples, clevis pins inserted through a bore in rail 101 adjacent or through arm 212; a spring-loaded clamp oriented either above or below arm 212 such that the clamp secures the arm when the ladder is in the open position.

The present invention further contemplates the use of an extension module that may be attached to the upper end of the stepped unit to increase the usable length of the ladder.

Figure 9:
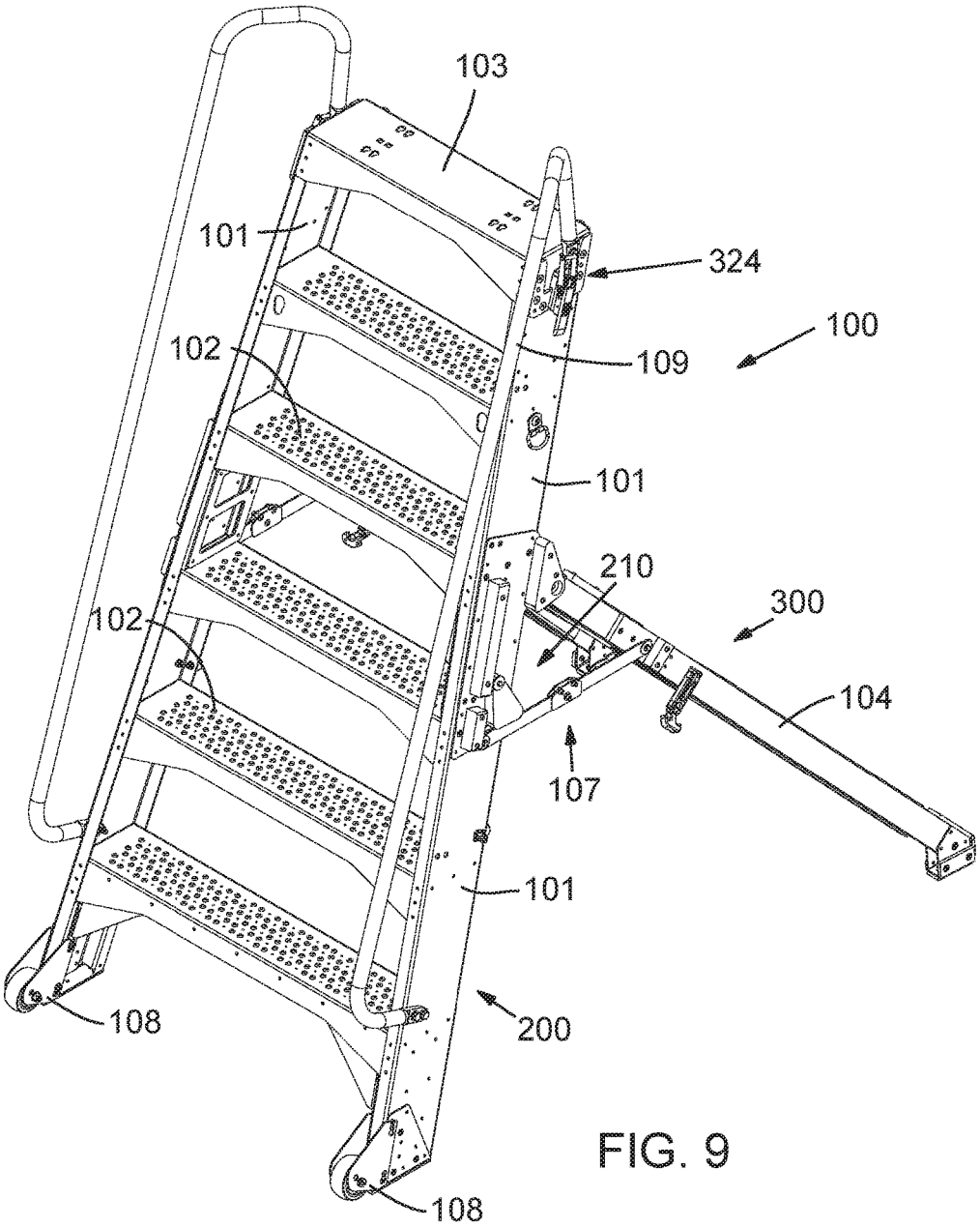
FIG. 9 is an upper perspective view of one embodiment of a ladder according to the invention, showing the ladder in the working position; the ladder shown in FIG. 9 incorporates structures that allow extension modules to be attached to the ladder.

Reference is now made to the drawings of FIGS. 9 through 19, which illustrate an extension module that is attached to ladder 100 to increase the working height of the ladder and the connecting structures that securely interconnect the extension module with the ladder. A ladder 100 that is designed for use with an extension module 310 defines the base module to which the extension module is attached, and includes cooperatively constructed interconnecting structures on the ladder 100 and the extension module 310 that operate to secure the extension module to the ladder. Different embodiments of these interconnecting structures are described below. In the illustration of FIG. 9, a ladder 100 is illustrated without an extension module 310 but including one element of an interface connector 324, that is, the half of the cooperative interface connector that is attached to the upper end of rail 101. The interface connectors 324 are described in detail below.

Figure 10:
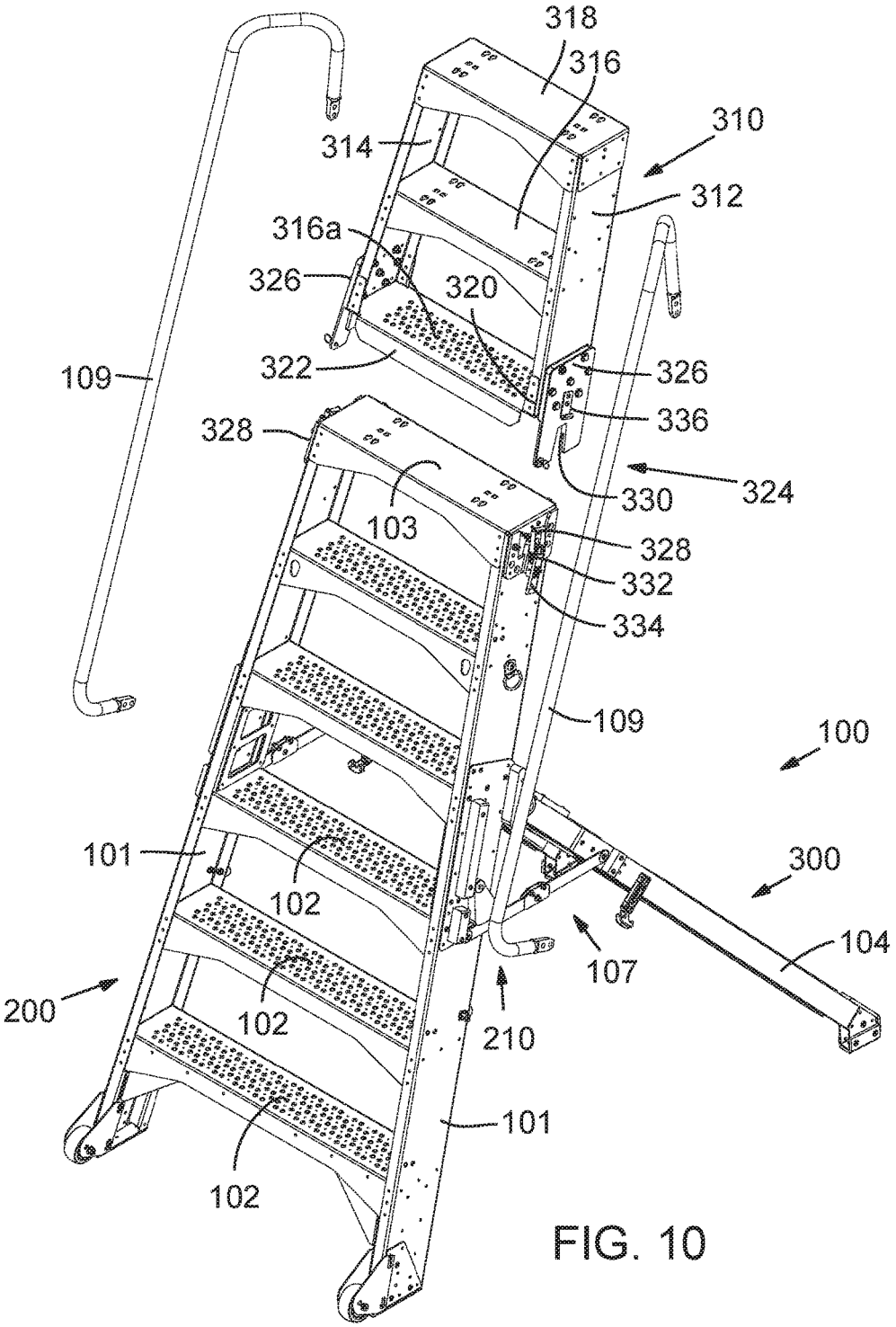
FIG. 10 is an upper perspective view of one embodiment of a ladder according to the invention, showing the ladder in the working position, with an extension module juxtaposed adjacent the ladder in exploded view.

With specific reference to FIG. 10 a ladder 100 as described above and includes the stepped unit 200 that is defined by side rails 101 interconnected with steps 102 and a top plate 103. Ladder 100 further includes the support unit 300. The extension module 310 is shown juxtaposed relative to and separated from the top plate 103. Extension module 310 is defined by opposed side rails 312 and 314 that are interconnected by plural steps 316 and top plate 318 in a manner analogous to the analogous components of ladder 100 described previously. The extension module 310 is sized appropriately that it mates with an existing ladder 100 in order to allow the extension module to be securely coupled to the ladder in the manner detailed below. The lowermost step of extension module 310 is labeled as step **316*a* and is located near the lower ends 320 of opposed rails 312 and 314 so that the lowermost step 316*a* abuts the top plate 103 of ladder 100 and the rails 312 and 314 align with rails 101 of stepped unit 200. A flange 322 extends downwardly from step 316*a* and overlaps with the forward edge of top plate 103 when the extension module is attached to the ladder. An identical flange (not visible in the view of FIG. 10) extends downwardly from step 316*a* on the opposite side of the step from that shown in FIG. 10—and overlaps with the opposite edge of the top plate 103 when the extension module is coupled with the ladder. The handrails 109 are also shown juxtaposed from the ladder 100 shown in FIG. 10. The handrails are securely attached at their bottom ends to the opposed rails 101 with, for example, bolts or quick release skewers that extend through bores in the handrails and through bores 70 and 72 (see, e.g., FIG. 8). The upper ends of the handrails 109 are attached to the upper ends of the opposed rails 312 and 314** in a like manner.

It will be noted that the physical spacing between top plate 103 and the closest adjacent step 102 is slightly less than the spacing between other steps 102 of the ladder 100. When the extension module 310 is mated to ladder 100, the top plate 103 of ladder 100 is, as noted above, brought into abutting or very close proximity with the lowermost step **316*a* of the extension module 310. This abutting relationship between the top plate 103 and the step 316*a* defines a step spacing that is consistent with the other step-to-step spacing of ladder 100. This structural arrangement also strengthens and adds rigidity to the interconnection between the extension module 310 and the ladder 100, thereby contributing to a solid connection between the two units, and the overlap of flanges 322 with top plate 103** effectively transforming the combined step into a fully functional step.

While the abutment of step **316*a* with top plate 103 contributes to the stability of the interconnection between the extension module 310 and the ladder 100, the primary interconnection between the two is provided by interface connectors, referred to generally with reference number 324. A first embodiment of an interface connector 324 is shown in the views of FIGS. 10 through 15 and comprises a first plate 326 that is securely attached to the lower end 320 of rail 312 of extension unit 310 such that a portion of the first plate 326 extends beyond the end of the rail 312. Likewise, an identical first plate 326 is attached in the same way to the lower end 320 of rail 314. A second plate 328 is securely attached to the upper end of rail 101 adjacent top plate 103—one second plate 328 is attached to each rail 101**.

The first and second plates 326 and 328, respectively, include structural features that contribute to a highly secure and stable connection between the extension module 310 and the ladder 100. With continuing reference to FIG. 10, first plate 326 has a generally V-shaped notch 330 formed in the lower edge of the plate. Second plate 328 includes a cooperatively formed V-shaped extension 332 facing V-shaped notch 330. When extension module 310 is connected to ladder 100 the V-shaped extension 332 of second plate 328 is received in the cooperatively formed V-shaped notch 330 of first plate 326, thereby stabilizing the interconnected first and second plates. Further, a pull-action toggle clamp 334 is attached to second plate 328 and a corresponding latch plate 336 with a hook portion is attached to first plate 326. When extension module 310 is connected to ladder 100 the arms 338 of the toggle clamp 334 (see FIG. 12) are extended over the corresponding hook portion of latch plate 336 and the toggle clamp is closed. This further secures the extension module 310 to the ladder 100, and the pulling action of the toggle clamp 334 adds additional strength to the interconnection. There is a toggle clamp 334 attached to each of the second plates 328 of ladder 100, and of course, the relative positions of the toggle clamp and the latch plates on first and second plates 326, 328 may be reversed.

Figure 11:
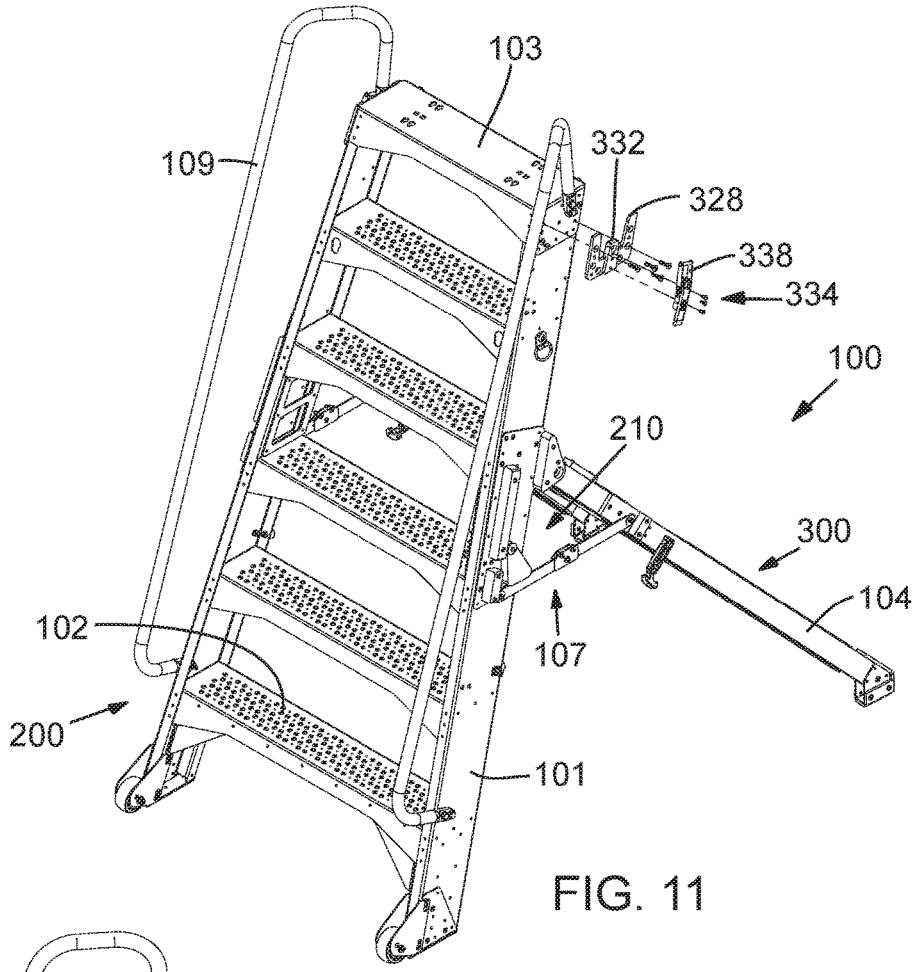
FIG. 11 is a close up perspective and exploded view of the upper end of the ladder shown in FIG. 10, showing in exploded view a first embodiment of a coupling mechanism according to the invention for secure attachment of an extension module to the ladder.
Figure 12:
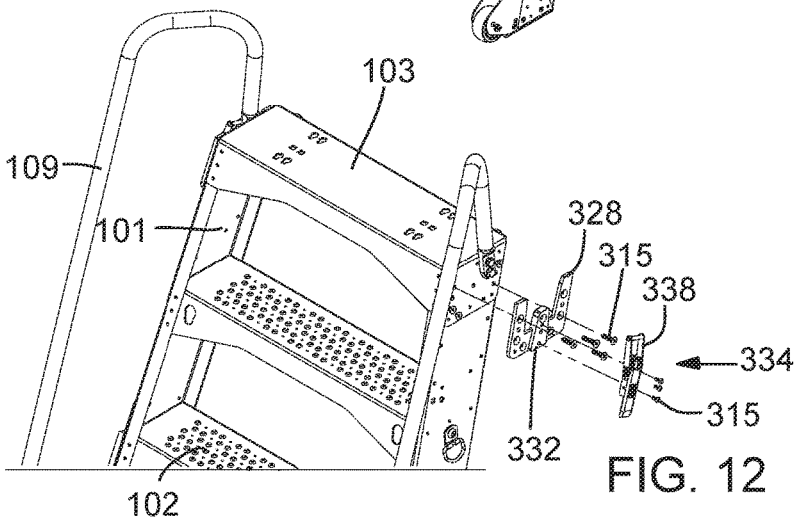
FIG. 12 is a close up, perspective and exploded view the close-up circle of FIG. 11 to illustrate the coupling mechanism.

The structure of the second plate 328 is shown in the close up and exploded views of FIGS. 11 and 12. Each of the second plates 328—i.e., one plate 328 is attached to each of the rails 101 of ladder 100—is secured to the upper edge 313 of a rail 101 with plural fasteners such as screws 315.

Figure 13:
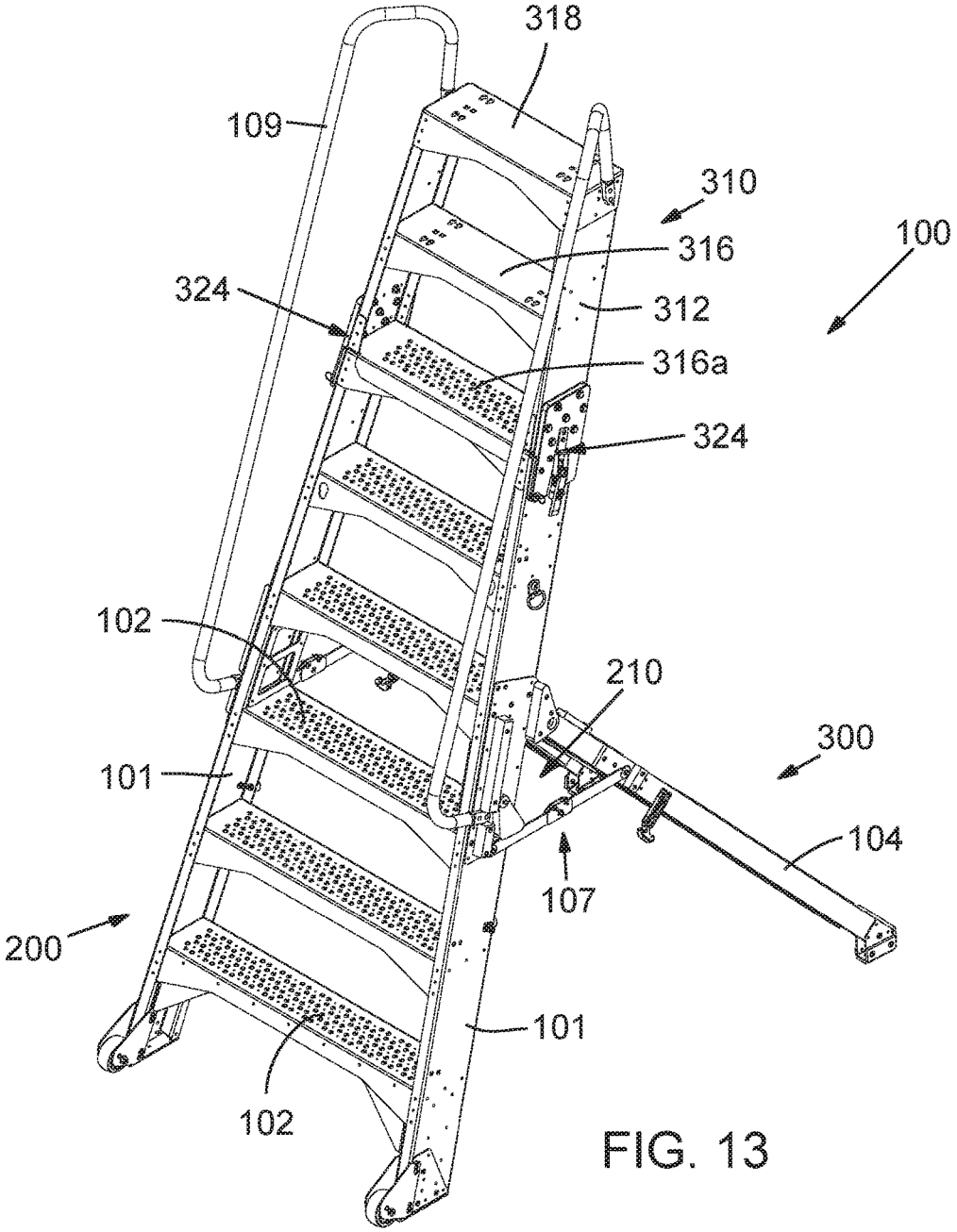
FIGS. 13 through 15 show three different ladders according to the invention in which extension modules of different lengths have been securely coupled to the ladder in order to extend the working length or height of the ladder. Specifically.
Figure 14:
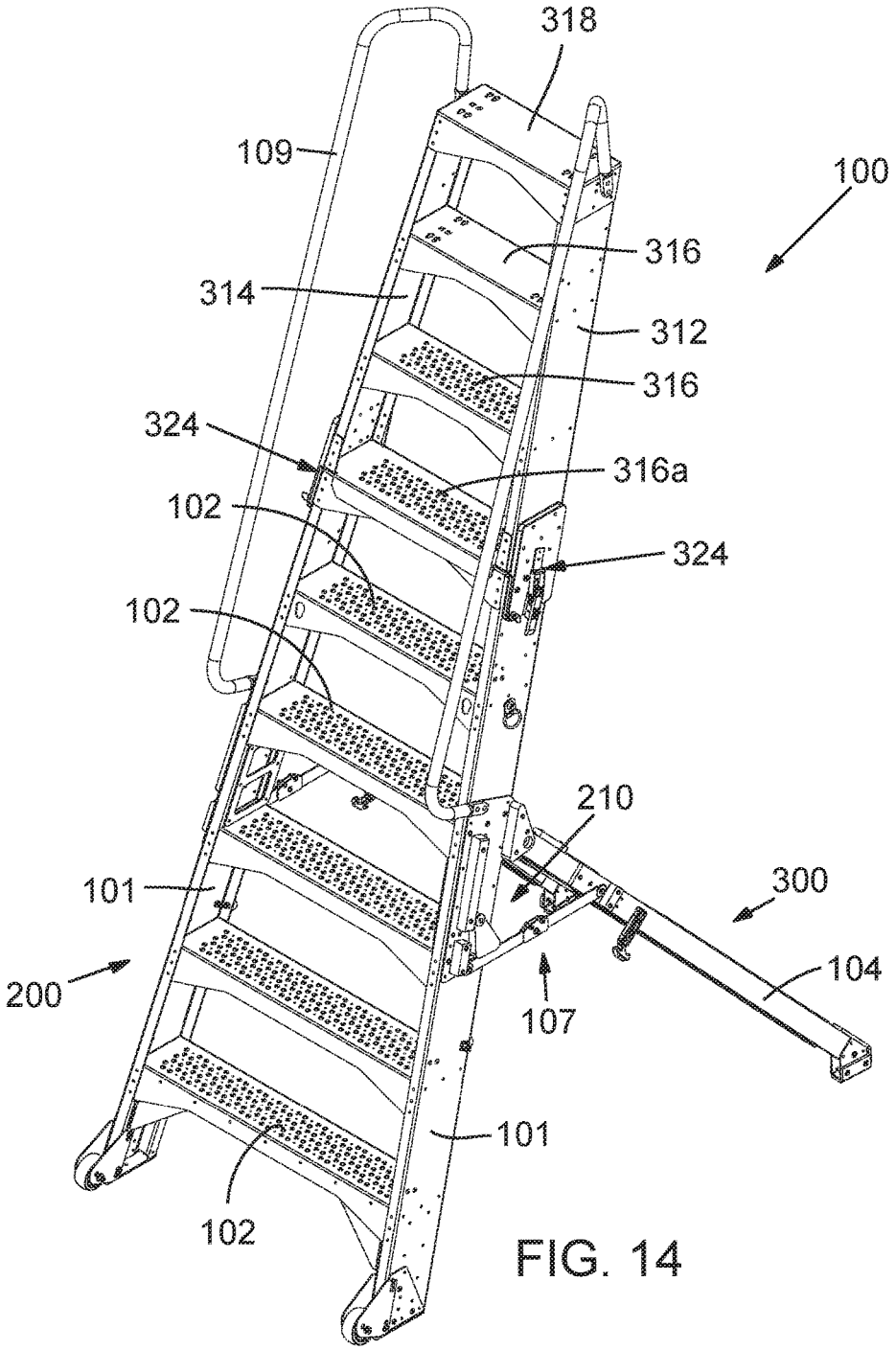
Figure 15:
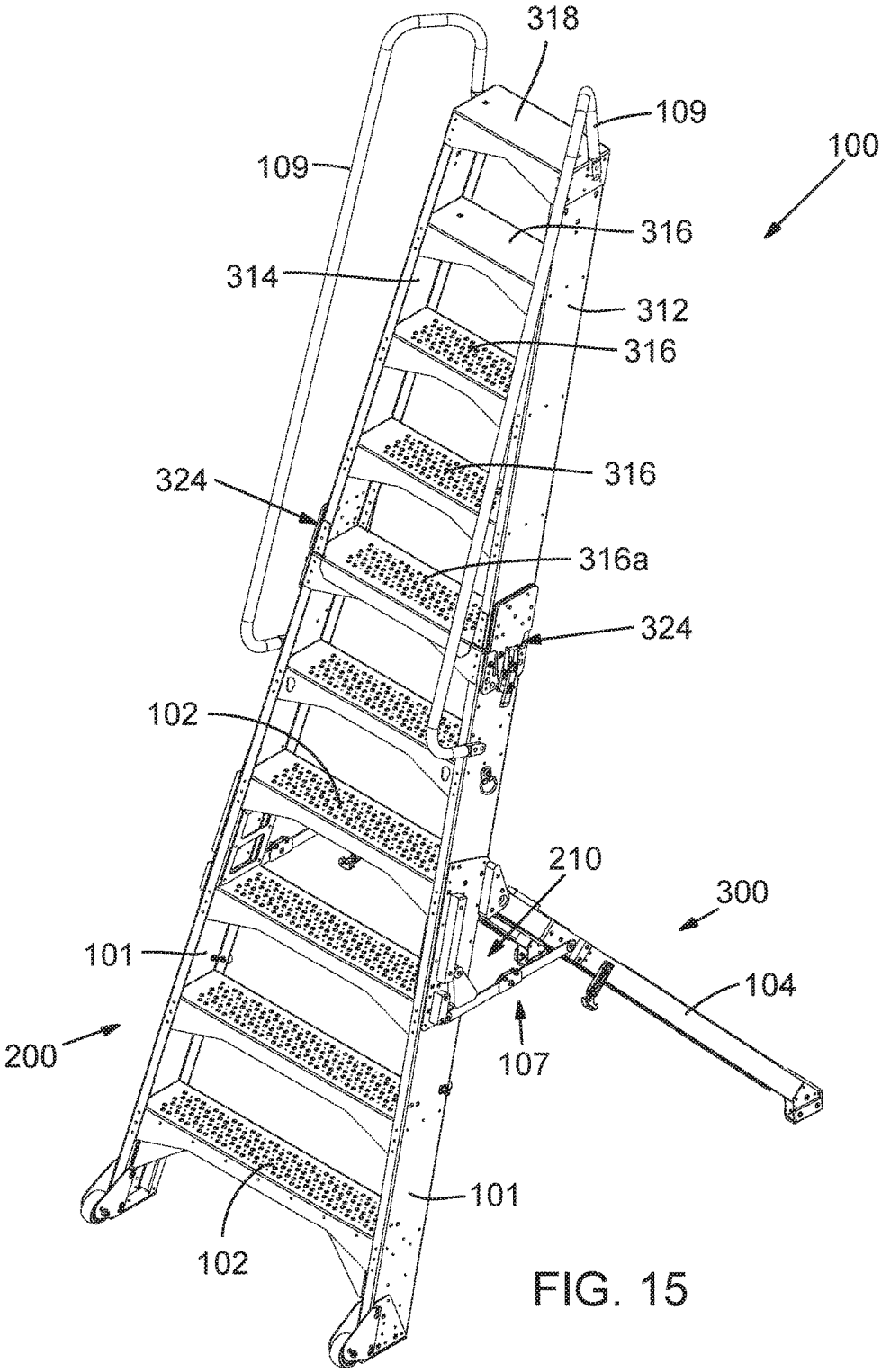
Figures 16, 17:
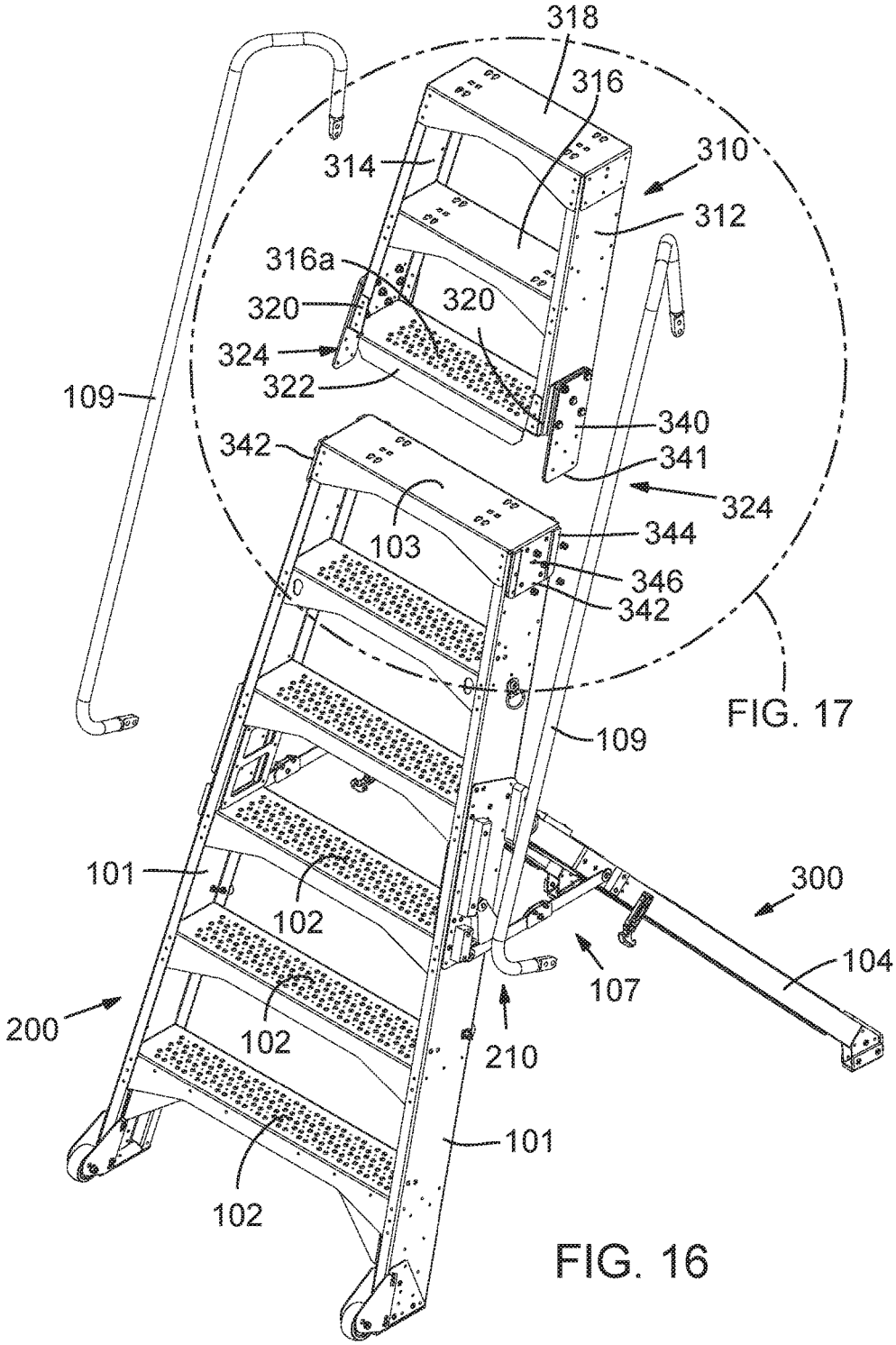
FIG. 16 is a perspective and partially exploded view of a ladder according to the invention and illustrating a second embodiment of a coupling mechanism that may be used to secure an extension module to the ladder base.
FIG. 17 is a close up, perspective and exploded view of the ladder and extension module of FIG. 16.
Figure 17:
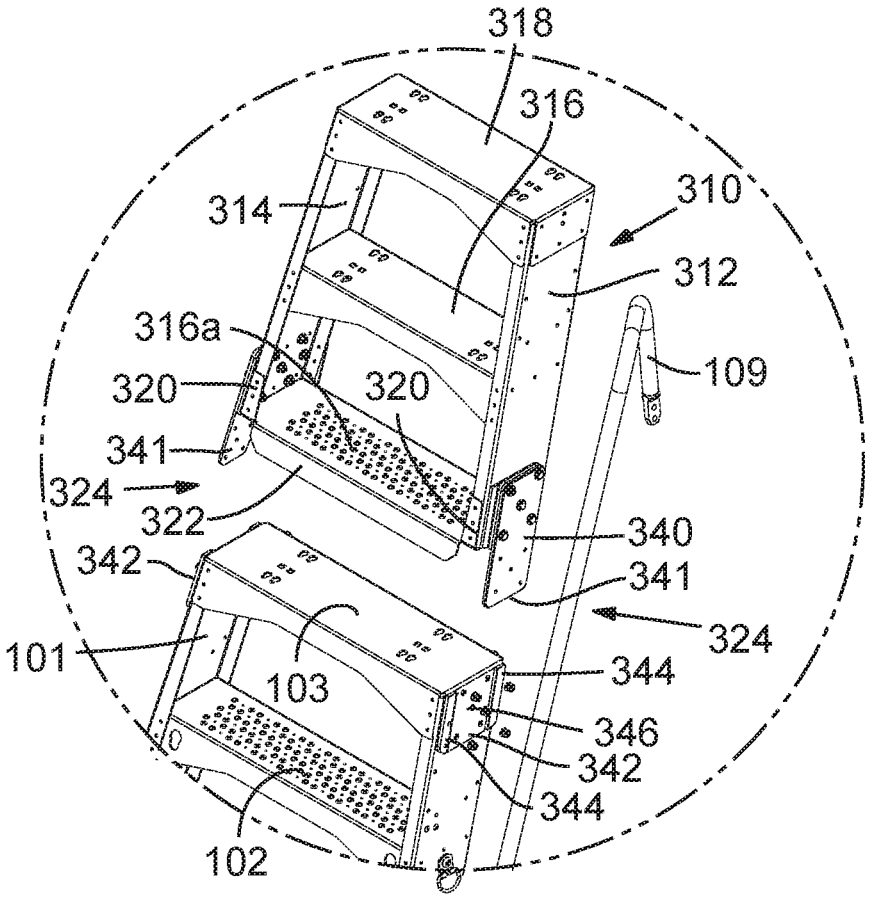

The length of extension module 310—that is, the number of steps 316 that may be incorporated into the extension module, may be varied and the maximum length of the extension module is dictated in large part by the specific dimensions of the ladder 100 to which the extension module 310 is to be coupled. FIGS. 13, 14 and 15 depict identical ladders 100 with three differently sized extension modules 310 coupled thereto with interface connectors 324 of the type described above. The ladder 100 in FIG. 13 has an extension module 310 with two steps 316 and a top step 318; the ladder 100 in FIG. 14 has an extension module with three steps 316 and a top step 318; and the ladder 100 in FIG. 15 has an extension module with four steps 316 and a top step 318.

Those of skill in the art will recognize that there are numerous structural equivalents that may be utilized to define the interface connectors 324 that couple the extension module 310 to the ladder 100, in addition to the embodiment described above in respect of FIGS. 9 through 15. A second embodiment of an interface connector 324 is shown in FIGS. 16 through 19. In the second embodiment a first plate 340 is securely attached to the lower end 320 of rail 312 of extension unit 310 and a portion of the first plate 340 extends beyond the end of the rail 312 to define a bayonet 341. An identical first plate 340 is attached in the same way to the lower end 320 of rail 314. Bayonet 341 may be an integral part of first plate 340, or may be attached to plate 340 as a separate piece. A second plate 342 is securely attached to the upper end of rail 101 adjacent top plate 103—one second plate 342 is attached to each rail 101. Second plate 342 includes shoulders 344 at the opposite lateral sides of the plate to define a channel 346 there between—the shoulders 344 may be formed as an integral part of the plate 342 or attached to the plate as separate pieces. The channel 346 has parallel side walls defined by the shoulders 344 and the width of the channel is adapted to be the same as the width of bayonet 341. As best seen in the close up view of FIG. 19, when extension module 310 is mated with ladder 100 the bayonet 341 is slid into the channel 346 and the mating structures help to stabilize the interconnected components. Further security between the extension module and the ladder is provided by securing the bayonet 341 to the second plate 342, for instance, with fasteners such as screws or threaded bolts that connect the two or with a latch similar to toggle clamp 334 described above, and more particularly with a bolt threaded through the aligned bores 343 and 345 in first plate 340 and second plate 342, respectively.

When an extension module 310 is coupled to a ladder 100 as described above the stepped base unit has support legs that are of sufficient length to support a step ladder of substantially greater length than the height of the base unit itself and the added height is provided by the extension module. In conventional step ladder designs, the stepped unit and the support unit are angled symmetrically and assume the shape of an isosceles triangle when the ladder is in its open position. But in the design of the present invention the angle measured between the stepped unit and the ground is greater than the angle measured between the support unit and the ground and when the ladder 100 is folded into its storage position the lower portion of the rails of the support unit extend beyond the feet of the stepped unit. Accordingly, this combination of structural features allows the ladder 100 to provide a footprint that is larger than footprint of a convention ladder, assuming isosceles triangle construction. In this way the ladder 100 with the extension module with its added steps securely coupled to the stepped unit will exhibit stability comparable to or greater than that of a conventional step ladder of similar height.

Figure 18:
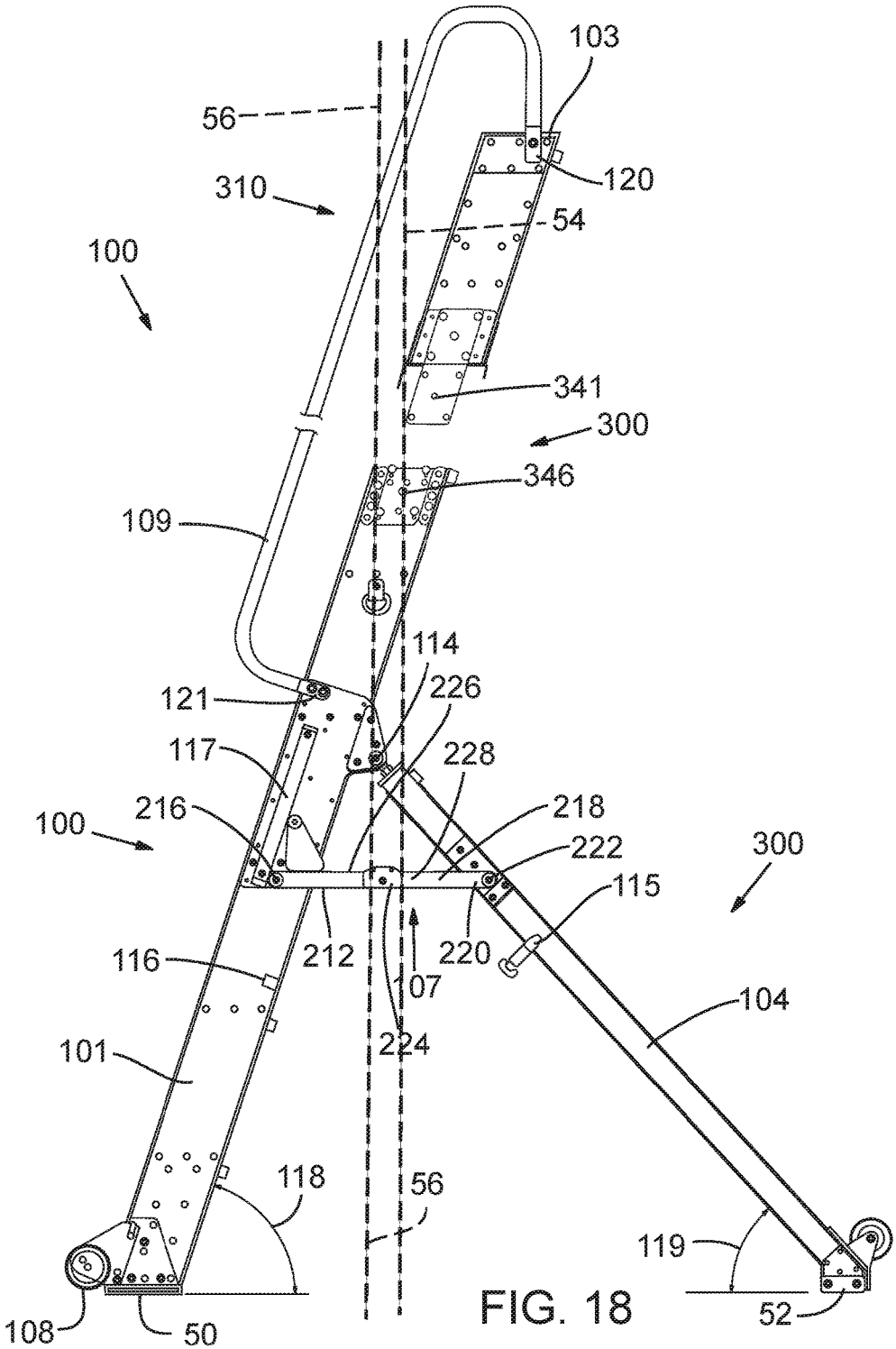
FIG. 18 is a side elevation view and partially exploded of a ladder according to the present invention in which an extension module is shown in a position ready to be secured to the ladder base.

Further, as may be seen in FIG. 18 and as noted above in respect of FIG. 4, it may be seen that when the ladder 100 is in the open, working position, the top plate 103 and the interconnection with extension module 310 is located beyond the hinge axis 114. In the view of FIG. 18, the triangle defined by the lines interconnecting the hinge axis 114, foot 50 and foot 52, the horizontal location of top plate 103 is to the right of hinge axis 114 and to the left of foot 52. Accordingly, when the ladder 100 is in the open position as shown and located on a horizontal ground plane, then a vertical line drawn from the top plate 103 to the ground plane intersects the line extending from the foot 50 to the foot 52 at a position intermediate between the intersection of a line extending from hinge axis 114 to the line extending from the foot 50 to the foot 52. These two vertical lines are illustrated in phantom lines in FIG. 18, labelled with reference numbers 54 and 56, respectively.

In addition to the interface connectors 324 that are described above, other suitable methods of securely attaching an extension module 310 to the ladder 100 include hinged connections, tapered joints with cooperative tapered receivers, finger joints, dovetail joints, wedge plates and others. Similarly, there are numerous ways to attach the interface connector components, including for example bolts and screws, pit pins, claims, hand wheels, etc.

Figure 20:
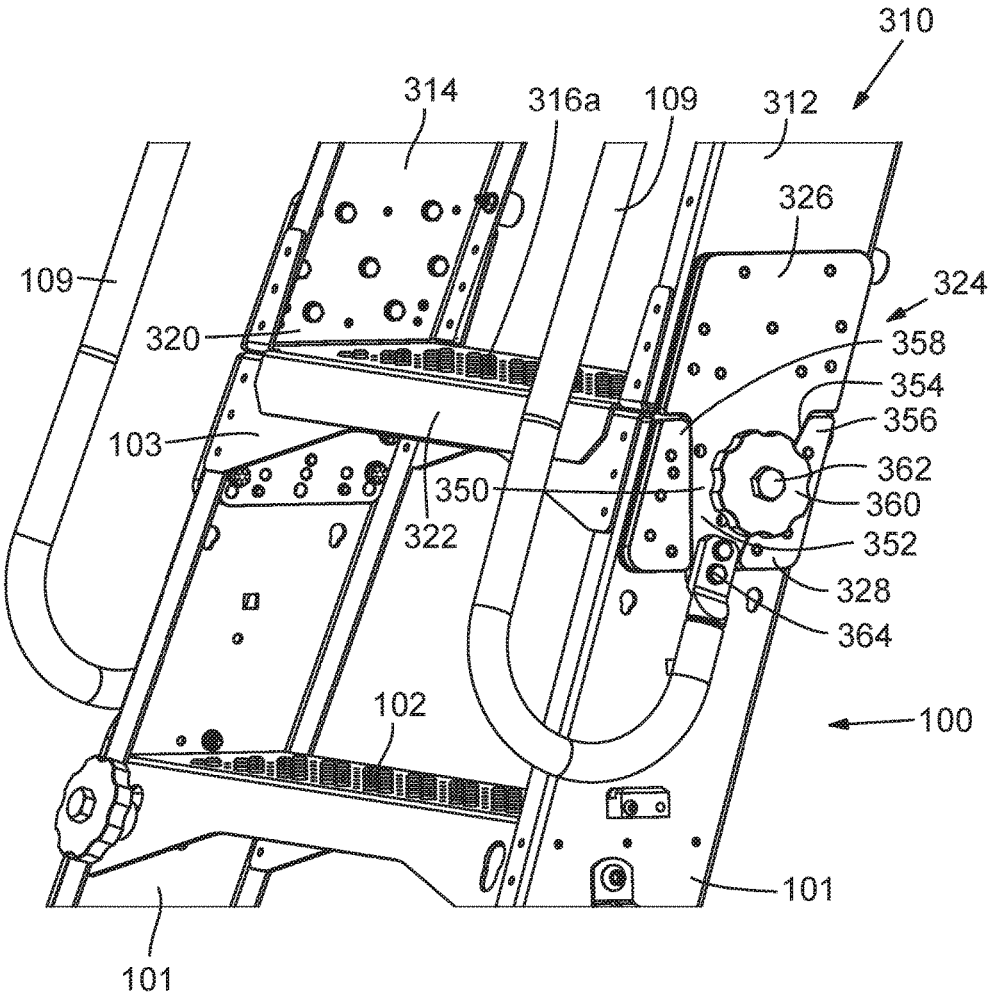
FIG. 20 is a close up perspective view of an alternative embodiment of a coupling mechanism for securing an extension module to a ladder.

Reference is now made to the alternative embodiment of an interface connector/coupling mechanism 324 for securing an extension module 310 to a ladder 100 as shown in FIG. 20. In the embodiment of FIG. 20 the first plate 326 is securely attached to the lower end 320 of rail 312 (with fasteners such as screws) and includes a downwardly oriented and substantially triangular extension 350 that has its apex 352 oriented at the lower end of the plate 326. The second plate 328 is securely attached to the upper end of rail 101 of ladder 100, adjacent top step 103 as shown and defines a cooperative structure for receiving the triangular extension 350 in a mating relationship. More specifically, second plate 328 forms a V-shaped notch 354 into which the triangular extension 350 is received. The second plate may be formed from two mirror image halves such as halves 356, 358 (as shown in FIG. 20), or alternately, the second plate 328 may be fabricated from a single plate of material.

When the extension module 310 is assembled onto a ladder 100 as shown in FIG. 20 the triangular extension 350 is received in the V-shaped notch 354 such that the sides of the extension align with and abut the facing sides of the notch. This in itself provides a stable and secure interconnection between the extension module and the ladder. However, a fastener is always provided to attach the extension 350 to the ladder 100 and in the instance of the embodiment of FIG. 20, a hand wheel 360 with a threaded bolt 362 extending therethrough is extended through a bore in the triangular extension 350 (the bore is not shown because it is blocked in the view of FIG. 20 by the hand wheel) and is screwed into an aligned threaded bore in rail 101 of ladder 100 (the treaded bore also is blocked in the view of FIG. 20). The hand wheel 360 and bolt 362 provide additional security for attaching the extension module 310 to ladder 100, and of course there is an identical coupling mechanism 324 associated with the rails on the opposite side of the ladder from that shown in the view of FIG. 20. As also seen in FIG. 20, the end 364 of handrail 109 in the embodiment of FIG. 20 is secured to the triangular extension 350 with a pair of bolts 364.

Figure 21:
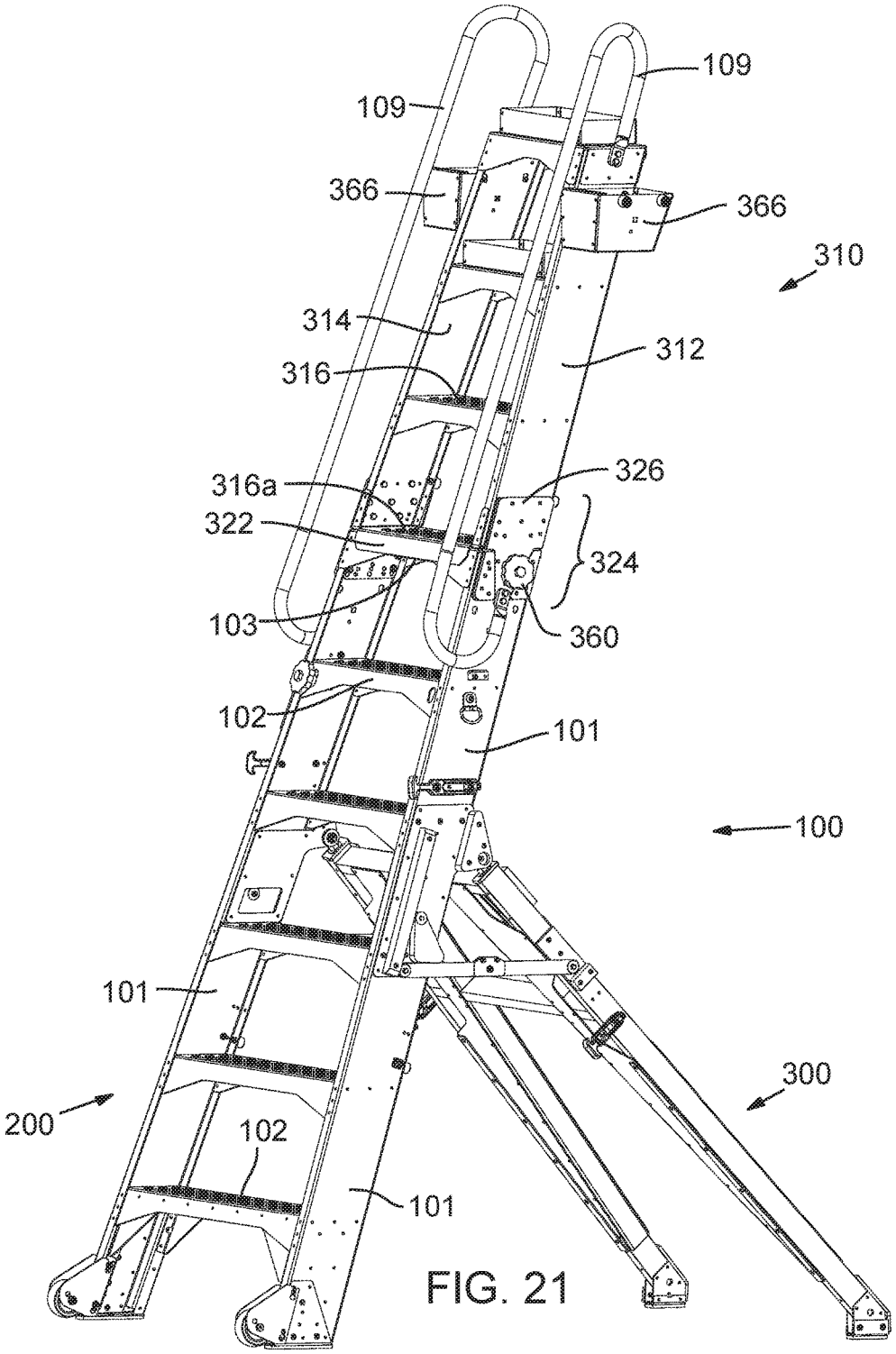
FIG. 21 is a perspective view of a ladder having an extension module secured thereto using the coupling mechanism shown in FIG. 20.

A ladder 100 having an extension module 310 secured to it with the coupling mechanism 324 as shown in FIG. 20 is illustrated in FIG. 21. A tool tray 366 is attached to each of the rails 312 and 314 in positions that allow a user to conveniently store tools and the like. The tool trays may be relocated wherever the user finds convenient with appropriate fasteners.

Figure 19:
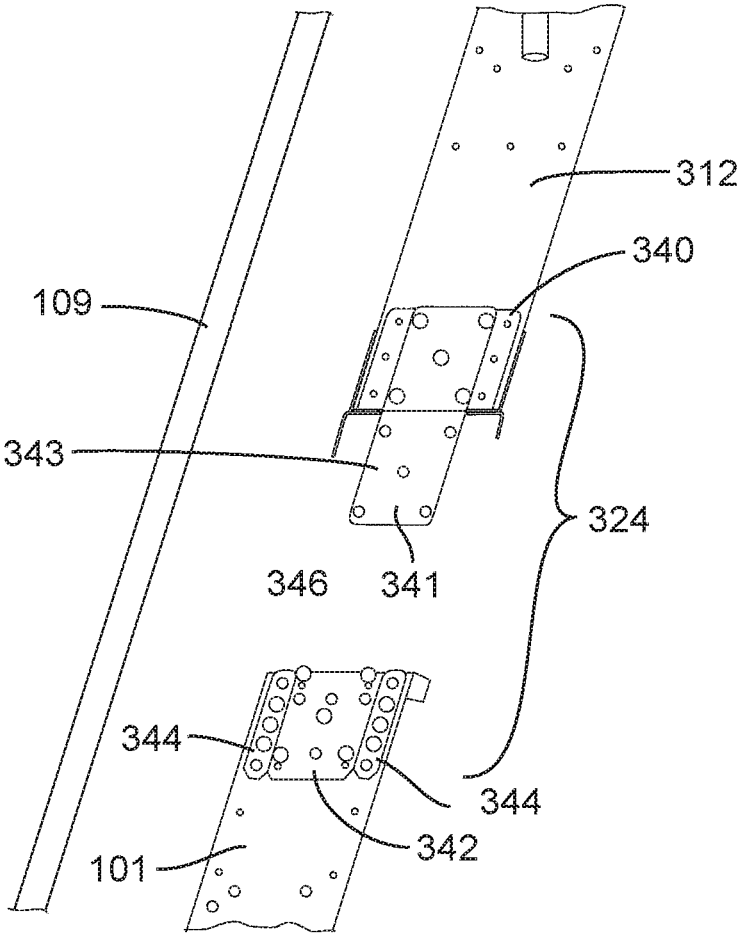
FIG. 19 is a close up and side elevation view of the portion of FIG. 18 that is shown in a close-up circle, illustrating the coupling mechanism for securing the extension module to the ladder base is illustrated

It will be appreciated that the embodiments of the coupling mechanisms 324 shown in, for instance, FIGS. 13, 19 and 20 provide very secure and stable interconnections between the ladder 100 and the extension module 310. The cooperative geometric configurations of the first plates and the second plates of the coupling mechanisms provide a primary stabilizing and securing modality, and secondary stabilizing and securing modality is provided by the attachment mechanisms defined by, for instance, the toggle 334 (FIG. 12), the interconnecting bolt (FIG. 19) and the hand wheel 360 (FIG. 20).

Figure 22:
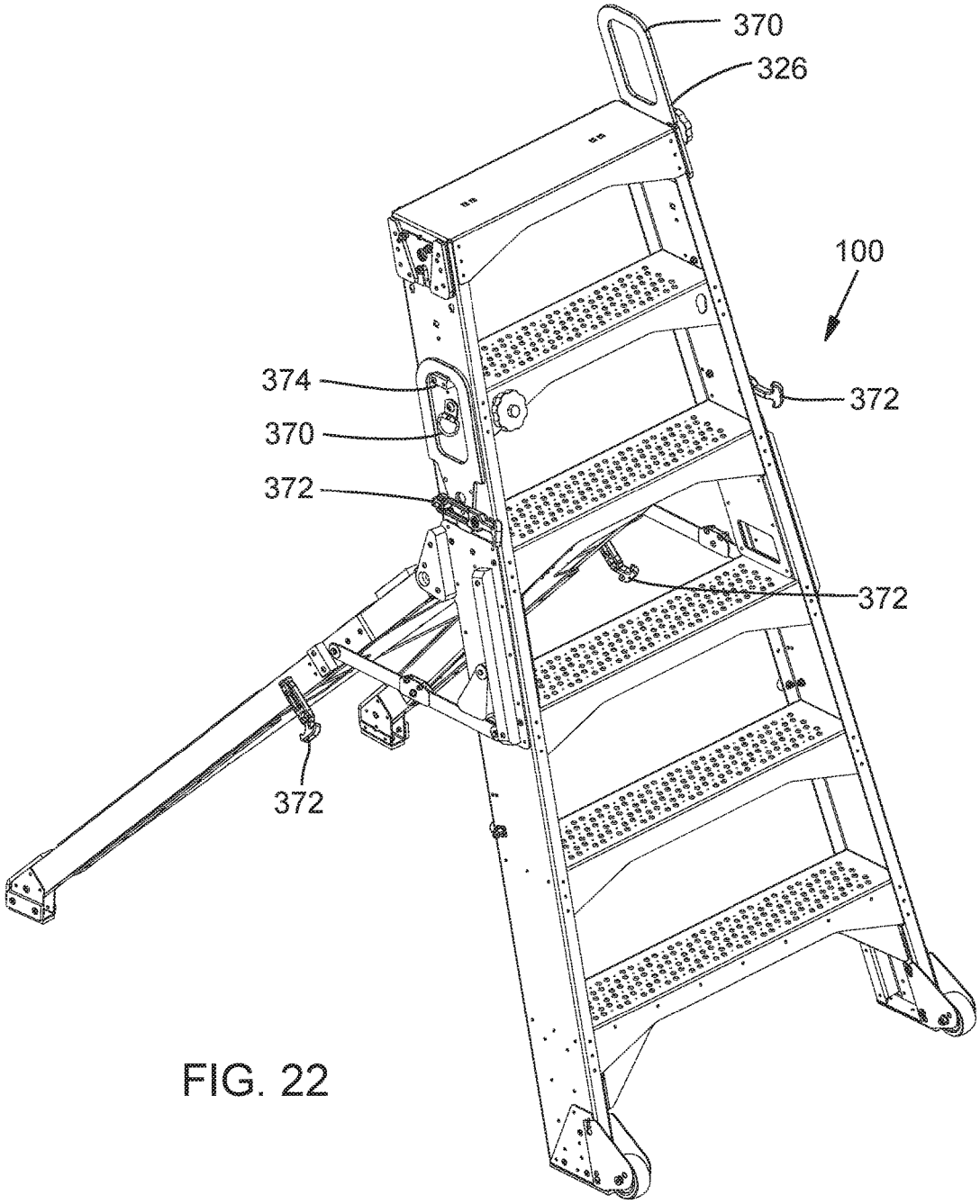
FIG. 22 is a perspective view of a ladder according to the invention that is adapted to use the coupling mechanism illustrated in FIG. 20 but in which one component of the coupling mechanism is modified to be also used as a hand hold.
Figure 23:
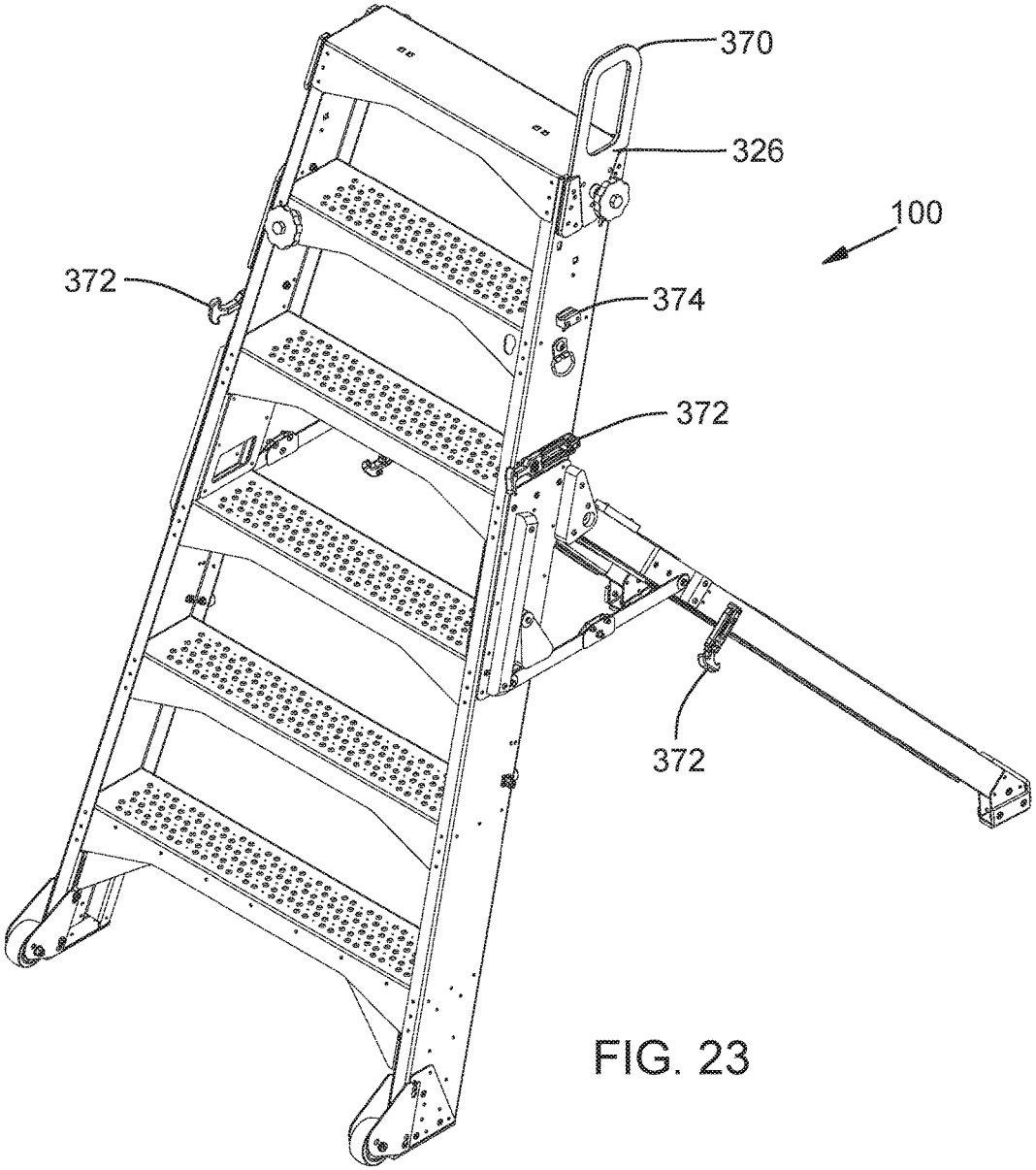
FIG. 23 is a perspective view of the ladder shown in FIG. 22, illustrating the opposite side of the ladder from that shown in FIG. 22

Finally, the ladder shown in FIGS. 22 and 23 is yet another embodiment of a ladder 100 that is adapted for attaching an extension module 310. However, the first plate 326 is adapted for use as a handle 370 rather than as a securement mechanism for attaching an extension module to the ladder. More specifically, as best seen in FIG. 23, the lower end of first plate 326 is identical to that described above in respect of FIG. 20, with a downwardly projecting triangular extension 350 that is received in the V-shaped notch 354 in second plate 328. However, the upper part of the first plate 326 is formed into the handle 370. As seen in FIG. 22, the handle 370 that is defined by the first plate 326 may be stored on rail 101 with appropriate mechanisms to secure the handle on the rail for storage, such as a strap 372 and bracket 374.

Figure 24:
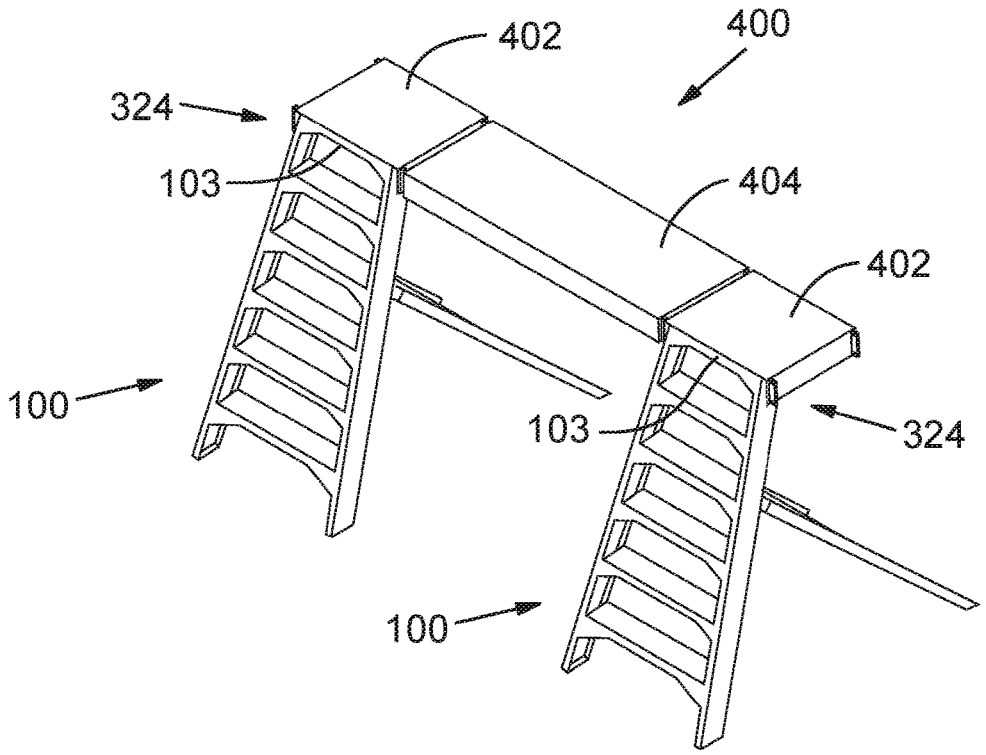
FIG. 24 is a perspective and schematic view of a pair of cantilevered ladders according to the present invention used to support and interconnect a work platform.

A ladder according to the present invention may also include, in place of the extension module described above, a standing platform that is attached to the top plate of the ladder in the same manner as the extension module, and which would include hand rails that extend appropriately to the standing platform. Additionally, two ladders according to the invention described herein can be located spaced apart from one another, in either parallel or perpendicular relative orientations, and a scaffolding-like work platform may be used to interconnect the two ladders. Reference is made to FIG. 24 in which two ladders 100 of the type described herein are used to support a work platform 400. The two outer ends of the work platform 400 are defined by primary platforms 402 that directly attach to the top step 103 of the ladders, and which include appropriate components of the coupling mechanism 324 to interconnect the primary platforms to the ladders. A work platform 404 interconnects the two primary platforms 402 with appropriate coupling mechanisms to define a complete, stabile scaffolding structure. Additional bracing may be added extending from the platform 400 to the ladders if desired for added strength, and hand rails may be added to the platform as necessary for safety considerations.

And it will be appreciated that the extension module 310 described herein is not limited to use with folding ladders but instead may be used with a rigid ladder that has the appropriated coupling mechanisms such as those detailed herein to attach the extension module to the ladder.

It is believed that the present invention as described and its many attendant advantages will be understood by the foregoing description. It is also believed that it will be apparent that various changes may be made in the form, construction and arrangements of the components thereof without departing from the scope and spirit of the invention and without sacrificing all of its material advantages. Thus the breadth and scope of the present invention should not be limited by any of the above-described exemplary embodiments, but should instead be defined only in accordance with the following claims and their equivalents.

We claim:

1. A step ladder, comprising:

a ladder base having a. a stepped unit defined by first and second stepped unit side rails, plural steps interconnecting the first and second stepped unit side rails, and a top plate interconnecting the first and second stepped unit side rails at an upper end thereof, the top plate having a forward edge and an opposite rearward edge, and b. a support unit hinged to the stepped unit such that the support unit may be pivoted relative to the stepped unit about the hinged connection to move the step ladder between open and folded configurations; and an extension module having a. first and second extension module side rails, each having upper and lower ends, plural steps interconnecting the extension module side rails and a top plate interconnecting the extension module side rails at the upper ends thereof;

b. a bottom step that abuts the top plate of the stepped unit when the extension module is connected to the ladder base, the bottom step having a forward edge and an opposite rearward edge, wherein the bottom step has a first flange extending downwardly from the forward edge and a second flange extending downwardly from the rearward edge and the first and second flanges overlap the respective forward and rearward edges of the top plate when the extension module is connected to the ladder base; and c. a connector attaching the extension module to the stepped unit.

2. The step ladder according to claim 1 in which the connector further comprises a primary coupling connection between the stepped unit and the extension module and a secondary coupling connection between the stepped unit and the extension module.

3. The step ladder according to claim 2 in which the primary coupling connection is defined by a first plate attached to the upper end of each of the first and second stepped unit side rails, and a second plate attached to the lower end of each of the first and second extension module side rails, wherein the first and second plates are cooperatively shaped to interconnect with one another.

4. The step ladder according to claim 3 in which the first plate defines a V-shaped notch and the second plate defines a triangular extension, and wherein the triangular extension extends beyond the lower end of the extension module side rail so that it is received in the V-shaped notch when the extension module is connected to the ladder base.

5. The step ladder according to claim 3 in which the first plate defines a V-shaped extension and the second plate defines a cooperatively shaped V-shaped notch for receiving the V-shaped extension when the extension module is connected to the ladder base.

6. The step ladder according to claim 3 in which the first plate defines a channel and the second plate defines a bayonet, and wherein the bayonet extends beyond the lower end of the extension module side rail so that it is received in the channel when the extension module is connected to the ladder base.

7. The step ladder according to claim 2 in which the secondary coupling connection is defined by a bolt that extends through a second plate and is threaded into the stepped unit side rail.

8. The step ladder according to claim 2 in which the secondary coupling connection is defined by a toggle clamp that interconnects the first and second plates.

9. In a step ladder that is movable between an open configuration and a folded configuration and in which the step ladder is defined by a ladder base having a stepped unit with first and second stepped unit side rails, plural steps interconnecting the first and second stepped unit side rails, and a top plate interconnecting the first and second stepped unit side rails at upper ends thereof, and a support unit having first and second side rails, the support unit hinged to the stepped unit at a hinge point, the improvement comprising:

an extension module selectively attachable to the stepped unit to extend the length thereof, the extension module having first and second extension module side rails, each having upper and lower ends, plural steps interconnecting the extension module side rails and a top plate interconnecting the extension module side rails at the upper ends thereof; and an extension module bottom step that abuts the top plate of the stepped unit when the extension module is connected to the stepped unit, the extension module bottom step having a forward edge and an opposite rearward edge, wherein the extension module bottom step has a first flange extending downwardly from the forward edge and a second flange extending downwardly from the rearward edge and the first and second flanges overlap respective forward and rearward edges of the top plate of the stepped unit when the extension module is connected to the stepped unit.

10. The step ladder according to claim 9 wherein each side rail of the stepped unit defines a stepped unit foot, each side rail of the support unit defines a support unit foot, and wherein the lower ends of the extension module side rails are oriented vertically between the hinge point and the support unit feet.

11. The step ladder according to claim 10 including a connector for coupling the extension module to the stepped unit in which the connector comprises a first plate attached to the upper end of each of the first and second support unit side rails, and a second plate attached to the lower end of each of the first and second extension module side rails, wherein the first and second plates are cooperatively shaped to interconnect with one another.

12. The step ladder according to claim 11 in which the first plate defines a V-shaped notch and the second plate defines a triangular extension, and wherein the triangular extension extends beyond the lower end of the extension module side rail so that it is received in the V-shaped notch when the extension module is assembled with the ladder base.

13. The step ladder according to claim 12 including a secondary coupler for attaching the second plate to the stepped unit.

* * * * *